US009018505B2

(12) United States Patent
Okuda

(10) Patent No.: US 9,018,505 B2
(45) Date of Patent: Apr. 28, 2015

(54) AUTOMATIC ACCOMPANIMENT APPARATUS, A METHOD OF AUTOMATICALLY PLAYING ACCOMPANIMENT, AND A COMPUTER READABLE RECORDING MEDIUM WITH AN AUTOMATIC ACCOMPANIMENT PROGRAM RECORDED THEREON

(71) Applicant: Casio Computer Co.,Ltd., Shibuya-ku, Tokyo (JP)

(72) Inventor: Hiroko Okuda, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/211,689

(22) Filed: Mar. 14, 2014

(65) Prior Publication Data

US 2014/0260915 A1 Sep. 18, 2014

(30) Foreign Application Priority Data

Mar. 14, 2013 (JP) ..... 2013-051160

(51) Int. Cl.
*G10H 1/38* (2006.01)
*G10H 7/00* (2006.01)

(52) U.S. Cl.
CPC ..... *G10H 1/38* (2013.01)

(58) Field of Classification Search
CPC ..... G10H 1/38
USPC ..... 84/613
See application file for complete search history.

(56) References Cited

U.S. PATENT DOCUMENTS

| | | | | |
|---|---|---|---|---|
| 4,966,052 | A * | 10/1990 | Shiraki et al. | 84/715 |
| 7,297,859 | B2 * | 11/2007 | Ueki et al. | 84/613 |
| 8,008,568 | B2 * | 8/2011 | Kobayashi | 84/613 |
| 8,314,320 | B2 | 11/2012 | Okuda | |
| 2008/0028919 | A1 * | 2/2008 | Ueki et al. | 84/613 |
| 2013/0305907 | A1 * | 11/2013 | Kakishita | 84/613 |
| 2014/0238220 | A1 * | 8/2014 | Nakamura | 84/613 |

FOREIGN PATENT DOCUMENTS

JP 2011-158855 A 8/2011

* cited by examiner

*Primary Examiner* — Jeffrey Donels
(74) *Attorney, Agent, or Firm* — Holtz, Holtz, Goodman & Chick PC

(57) ABSTRACT

An automatic accompaniment apparatus is provided. The apparatus is provided with a music database having music data of plural musical pieces recorded therein, the music data including melody information and chords corresponding to the melody information, a performance recording unit for recording performance information for giving an instruction of generating a musical tone in response to performed operation, a music searching unit for searching for music data including melody information corresponding to the performance information in the performance recording unit through the music database, a chord judging unit for judging chords from the performance information in the performance recording unit, a chord selecting unit for selecting one of the chords included in the music data found by the music searching unit and the chords judged by the chord judging unit, and an automatic accompaniment unit for giving an instruction of generating accompaniment in accordance with the selected chords.

11 Claims, 23 Drawing Sheets

FIG. 12

| MUSIC NUMBER | TITLE | KEY/BEAT↓ NOTE | 1 | 2 | 3 | 4 | 5 | 6 | 7 |
|---|---|---|---|---|---|---|---|---|---|
| 1 | LITTLE FOX | C/4 | C | D | E | F | G | G | G |
| | | INTERVALS FROM OPENING/PRECEDING TONE | C | 2 | 2 | 1 | 2 | 0 | 0 |
| | | ST RATIOS TO OPENING TONE | 1 | 1 | 1 | 1 | 1 | 1 | 2 |
| | | CHORDS | C | → | → | → | → | → | → |
| 2 | SONG OF SPARROWS | C/4 | C | D | E | C | D | E | G |
| | | INTERVALS FROM OPENING/PRECEDING TONE | C | 2 | 2 | -4 | 2 | 2 | 3 |
| | | ST RATIOS TO OPENING TONE | 1 | 1 | 2 | 1 | 1 | 2 | 1 |
| | | CHORDS | C | → | → | → | → | → | → |
| 3 | SONG OF FROGS | C/4 | C | D | E | F | E | D | C |
| | | INTERVALS FROM OPENING/PRECEDING TONE | C | 2 | 2 | 1 | 1 | 2 | 2 |
| | | ST RATIOS TO OPENING TONE | 1 | 1 | 1 | 1 | 1 | 1 | 1 |
| | | CHORDS | C | → | → | F | G7 | → | C |
| 4 | ARE YOU SLEEPING | C/4 | C | D | E | C | C | D | E |
| | | INTERVALS FROM OPENING/PRECEDING TONE | C | 2 | 2 | -4 | 0 | 2 | 2 |
| | | ST RATIOS TO OPENING TONE | 1 | 1 | 1 | 1 | 1 | 1 | 1 |
| | | CHORDS | C | → | → | → | → | → | → |
| 5 | OH SUSANNA | C/4 | C | D | E | G | G | A | G |
| | | INTERVALS FROM OPENING/PRECEDING TONE | C | 2 | 2 | 3 | 0 | 2 | -2 |
| | | ST RATIOS TO OPENING TONE | 1 | 1 | 2 | 2 | 3 | 1 | 2 |
| | | CHORDS | C | → | → | → | → | → | → |
| 6 | PORT | C/3 | C | D | E | E | G | A | G |
| | | INTERVALS FROM OPENING/PRECEDING TONE | C | 2 | 2 | 0 | 2 | 2 | -2 |
| | | ST RATIOS TO OPENING TONE | 1 | 1 | 2 | 2 | 1 | 1 | 2 |
| | | CHORDS | C | → | → | → | → | → | → |
| 7 | PIGEONS | C/4 | C | D | E | G | E | C | D |
| | | INTERVALS FROM OPENING/PRECEDING TONE | C | 2 | 2 | 3 | -3 | -4 | 2 |
| | | ST RATIOS TO OPENING TONE | 1 | 1 | 2 | 0.5 | 0.5 | 1 | 2 |
| | | CHORDS | C | G | C | → | → | → | G |
| 8 | KITES | C/4 | C | D | E | G | A | G | C |
| | | INTERVALS FROM OPENING/PRECEDING TONE | C | 2 | 2 | 3 | 2 | -2 | 5 |
| | | ST RATIOS TO OPENING TONE | 1 | 0.33 | 0.33 | 0.33 | 0.33 | 0.33 | 1.3 |
| | | CHORDS | C | → | → | → | → | → | F |
| 9 | PLOVERS | C/3 | C | D | E | G | A | C | G |
| | | INTERVALS FROM OPENING/PRECEDING TONE | C | 2 | 2 | 3 | 2 | 3 | -5 |
| | | ST RATIOS TO OPENING TONE | 1 | 0.5 | 1 | 0.5 | 1 | 0.5 | 1.5 |
| | | CHORDS | C | → | → | → | F | → | C |

FIG. 14

| | MELODY HISTORY → | | | | | | |
|---|---|---|---|---|---|---|---|
| | 1 | 2 | 3 | 4 | 5 | 6 | 7 |
| ENTERED PITCHES | **C** | **D** | **E** | **F** | **G** | **G** | **G** |
| INTERVALS FROM OPENING/PRECEDING TONE | C | 2 | 2 | 1 | 2 | 0 | 0 |
| ST RATIOS TO OPENING TONE | 1 | 1 | 1 | 1 | 1 | 1 | 2 |

FIG. 15

EXAMPLE OF F-LIST

| ORDER | MUSIC NUMBER | TITLE |
|---|---|---|
| 1 | 1 | LITTLE FOX |
| 2 | 2 | SONG OF SPARROWS |
| 3 | 3 | SONG OF FROGS |
| 4 | 4 | ARE YOU SLEEPING |
| 5 | 5 | OH SUSANNA |
| 6 | 6 | PORT |
| 7 | 7 | PIGEONS |
| 8 | 8 | KITES |
| 9 | 9 | PLOVERS |
| ⋮ | ⋮ | ⋮ |

FIG. 16A

ENTERED MELODY HISTORY

| | MELODY HISTORY → | | | |
|---|---|---|---|---|
| | 1 | 2 | 3 | 4 |
| ENTERED PITCHES | **F** | **G** | **A** | **B♭** |
| INTERVALS FROM OPENING/PRECEDING TONE | F | 2 | 2 | 1 |
| ST RATIOS TO OPENING TONE | 1 | 0.9 | 1.1 | 1 |

~

* ESTABLISHED KEY = F

FIG. 16B

EXAMPLE OF K-LIST

| ORDER | MUSIC NUMBER | TITLE | ACCURATE RATE |
|---|---|---|---|
| 1 | 1 | LITTLE FOX | 100−(10+10+0) / 3=93.3POINTS |
| 2 | 3 | SONG OF FROGS | 100−(10+10+0) / 3=93.3POINTS |
| ⋮ | ⋮ | ⋮ | ⋮ |

FIG. 17A

ENTERED MELODY HISTORY

| | MELODY HISTORY → | | |
|---|---|---|---|
| | 1 | 2 | 3 |
| ENTERED PITCHES | **C** | **D** | **E** |
| INTERVALS FROM OPENING/PRECEDING TONE | C | 2 | 2 |
| ST RATIOS TO OPENING TONE | 1 | 1 | 1 |

~

FIG. 17B

EXAMPLE OF N-LIST

| ORDER | MUSIC NUMBER | TITLE | ACCURATE RATE |
|---|---|---|---|
| 1 | 1 | LITTLE FOX | 100−(0+0) / 2=100POINTS |
| 2 | 3 | SONG OF FROGS | 100−(0+0) / 2=100POINTS |
| 3 | 4 | ARE YOU SLEEPING | 100−(0+0) / 2=100POINTS |
| 4 | 2 | SONG OF SPARROWS | 100−(0+50) / 2=75POINTS |
| 5 | 5 | OH SUSANNA | 100−(0+50) / 2=75POINTS |
| 6 | 6 | PORT | 100−(0+50) / 2=75POINTS |
| 7 | 7 | PIGEONS | 100−(0+50) / 2=75POINTS |
| 8 | 9 | PLOVERS | 100−(100+0) / 2=50POINTS |
| 9 | 8 | KITES | 100−(200+200) / 2=▲100POINTS |
| ⋮ | ⋮ | ⋮ | ⋮ |

FIG. 18A

ENTERED MELODY HISTORY

| | MELODY HISTORY → | | |
|---|---|---|---|
| | 1 | 2 | 3 |
| ENTERED PITCHES | F | G | A |
| INTERVALS FROM OPENING/PRECEDING TONE | C | 2 | 2 |
| ST RATIOS TO OPENING TONE | 1 | 1 | 1 |

~

FIG. 18B

EXAMPLE OF N-LIST

| | | | |
|---|---|---|---|
| ⋮ | ⋮ | ⋮ | ⋮ |

FIG. 18C

EXAMPLE OF D-LIST

| ORDER | MUSIC NUMBER | TITLE | ACCURATE RATE |
|---|---|---|---|
| 1 | 1 | LITTLE FOX | 100−(0+0) / 2=100POINTS |
| 2 | 3 | SONG OF FROGS | 100−(0+0) / 2=100POINTS |
| 3 | 4 | ARE YOU SLEEPING | 100−(0+0) / 2=100POINTS |
| 4 | 2 | SONG OF SPARROWS | 100−(0+50) / 2=75POINTS |
| 5 | 5 | OH SUSANNA | 100−(0+50) / 2=75POINTS |
| 6 | 6 | PORT | 100−(0+50) / 2=75POINTS |
| 7 | 7 | PIGEONS | 100−(0+50) / 2=75POINTS |
| 8 | 9 | PLOVERS | 100−(100+0) / 2=50POINTS |
| 9 | 8 | KITES | 100−(200+200) / 2=▲100POINTS |
| ⋮ | ⋮ | ⋮ | ⋮ |

FIG. 19

EXAMPLE OF GENERAL LIST

| ORDER | MUSIC NUMBER | TITLE | ACCURATE RATE |
|---|---|---|---|
| 1 | 1 | LITTLE FOX | 100−(0+0) / 2=100POINTS |
| 2 | 3 | SONG OF FROGS | 100−(0+0) / 2=100POINTS |
| 3 | 4 | ARE YOU SLEEPING | 100−(0+0) / 2=100POINTS |
| 4 | 2 | SONG OF SPARROWS | 100−(0+50) / 2=75POINTS |
| 5 | 5 | OH SUSANNA | 100−(0+50) / 2=75POINTS |
| 6 | 6 | PORT | 100−(0+50) / 2=75POINTS |
| 7 | 7 | PIGEONS | 100−(0+50) / 2=75POINTS |
| 8 | 9 | PLOVERS | 100−(100+0) / 2=50POINTS |
| 9 | 8 | KITES | 100−(200+200) / 2=▲100POINTS |
| ⋮ | ⋮ | ⋮ | ⋮ |

FIG. 20

2000 t →

| MELODY TONES | C | D | E | F | B |
|---|---|---|---|---|---|
| DURATIONS | 480 | 480 | 480 | 480 | 480 |
| ASSUMED KEYS | C | C | C | C | C |
| ASSUMED CHORDS | C omit3 | C omit3 | C | C | C |
| ASSUMED FUNCTIONS | I T | I T | I T | I T | I T |
| MELODY TONE HISTORIES | C | CD | CDE | CDEF | CDEFB |
| KEY CANDIDATES | CGFBbEbAbDb | CGFBbEb | CGF | CF | C |
| ESTABLISHED KEY | | | | | C |
| | 2001 | 2002 | 2003 | 2004 | 2005 |

FIG. 21

2100

2101

2102

| | DIATONIC SCALE | | | | | | | | | | | |
|---|---|---|---|---|---|---|---|---|---|---|---|---|
| KEY | C | C# | D | Eb | E | F | F# | G | Ab | A | Bb | B |
| Gb | | Db | | Eb | | F | Gb | | Ab | | Bb | Cb |
| Db | C | Db | | Eb | | F | Gb | | Ab | | Bb | |
| Ab | C | Db | | Eb | | F | | G | Ab | | Bb | |
| Eb | C | | D | Eb | | F | | G | Ab | | Bb | |
| Bb | C | | D | Eb | | F | | G | | A | Bb | |
| F | C | | D | | E | F | | G | | A | Bb | |
| C | C | | D | | E | F | | G | | A | | B |
| G | C | | D | | E | | F# | G | | A | | B |
| D | | C# | D | | E | | F# | G | | A | | B |
| A | | C# | D | | E | | F# | | G# | A | | B |
| E | | C# | | D# | E | | F# | | G# | A | | B |
| B | | C# | | D# | E | | F# | | G# | | A# | B |

FIG. 22

2200

| | ASSUMED-CHORD DETERMINING MAP | | | | | | | | | | | |
|---|---|---|---|---|---|---|---|---|---|---|---|---|
| MELODY TONES | C | C# | D | Eb | E | F | F# | G | Ab | A | Bb | B |
| CHORD NAMES | C Major | C#Major | Dm | EbMajor | C Major | F Major | F#Major | G Major | Fm | Am | BbMajor | G Major |

FIG. 23

2300

| | AVAILABLE CHORDS | | | | | | | | | | | |
|---|---|---|---|---|---|---|---|---|---|---|---|---|
| | C | C# | D | Eb | E | F | F# | G | Ab | A | Bb | B |
| I Major | C | | D | | E | F | | G | | A | | B |
| I M7 | C | | D | | E | F | | G | | A | | B |
| IIm | C | | D | | E | F | | G | | A | | B |
| IIm7 | C | | D | | E | F | | G | | A | | B |
| IIm7-5 | C | | D | | E | F | | G | Ab | | Bb | |
| IIIm | C | | D | | E | F | | G | | A | | B |
| IIIm7 | C | | D | | E | F | | G | | A | | B |
| III Major | C | | D | | E | | F# | | G# | A | | B |
| III7 | C | | D | | E | F | | | G# | A | | B |
| III7sus4 | C | | D | | E | F | | | G# | A | | B |
| IV Major | C | | D | | E | F | | G | | A | | B |
| IVM7 | C | | D | | E | F | | G | | A | | B |
| IVm | C | | D | | E | F | | G | Ab | | Bb | |
| IVmM7 | C | | D | | E | F | | G | Ab | | Bb | |
| V Major | C | | D | | E | F | | G | | A | | B |
| V7 | C | | D | | E | F | | G | | A | | B |
| V7sus4 | C | | D | | E | F | | G | | A | | B |
| VIm | C | | D | | E | | F# | | G# | A | | B |
| VIm7 | C | | D | | E | F | | G | | A | | B |
| VImM7 | C | | D | | E | | F# | | G# | A | | B |
| VIIm7-5 | C | | D | | E | F | | G | | A | | B |

FIG. 24

2400

| PREVIOUS CHORD FUNCTIONS | C D | C E | C F | C G | C Ab | C A | C B | --- |
|---|---|---|---|---|---|---|---|---|
| TO | V Major | I Major | IV Major | I Major | IV m | IV Major | V Major | --- |
| SU | II m7 | I Major | IV Major | I Major | IV m | IV Major | V Major | --- |
| DO | V Major | I Major | V Major | I Major | IV m | VI m | I Major | --- |

AUTOMATIC ACCOMPANIMENT APPARATUS, A METHOD OF AUTOMATICALLY PLAYING ACCOMPANIMENT, AND A COMPUTER READABLE RECORDING MEDIUM WITH AN AUTOMATIC ACCOMPANIMENT PROGRAM RECORDED THEREON

CROSS-REFERENCE TO RELATED APPLICATION

The present application is based upon and claims the benefit of priority from the prior Japanese Patent Application No. 2013-051160, filed Mar. 14, 2013, the entire contents of which are incorporated herein by reference.

BACKGROUND OF THE INVENTION

1. Field of the Invention

The present invention relates to an automatic accompaniment apparatus, a method of automatically playing accompaniment, and a computer readable recording medium with an automatic accompaniment program recorded thereon.

2. Description of the Related Art

In general, when playing musical instruments with a keyboard, such as pianos and organs, or electronic keyboards and electronic pianos, performers play a melody with his/her right hand and an accompaniment with his/her left hand.

But moving the both hands simultaneously to play the musical instrument, the performers are required to do reasonable practice. In particular, it is relatively easy to play a melody with the right hand, but many performers, particularly, beginner performers feel it hard to play accompaniment with the left hand while playing a melody with the right hand. In these situations, electronic musical instruments have been actualized, which automatically produce and play appropriate chords to a melody played by the performer with his/her right hand, whereby the performer is not required to play the chords with his/her left hand. Using the instrument, even such beginner performers can easily enjoy playing the performance.

For example, Japanese Unexamined Patent Publication No. 2011-158855 discloses an electronic musical instrument which can determine appropriate chord names in accordance with weights of melody tones and their succession.

The electronic musical instrument described in Japanese Unexamined Patent Publication No. 2011-158855 uses positions of beats of the melody tone, weights of beats, a melody tone at the leading beat, and chord names to judge chords to be played. A melody progression of general music and chords to be played to a melody vary widely, and particularly in music, chords to be played with melody progression are judged much based on human sense and it has been required to further enhance accuracy in mechanically playing chords to melody tones.

The present invention has been made in consideration of inconvenience involved in conventional techniques, and provides an automatic accompaniment apparatus, a method of automatically playing accompaniment, and a computer readable recording medium with an automatic accompaniment program recorded thereon, which can promptly play appropriate chords with high accuracy based on a melody tone history.

SUMMARY OF THE INVENTION

According to one aspect of the invention, there is provided an automatic accompaniment apparatus which comprises a music database having plural pieces of music data recorded therein, the plural pieces of music data corresponding respectively to plural musical pieces, and each piece of music data including melody information and chords corresponding to the melody information, a performance recording unit which records performance information for successively giving an instruction of generating a musical tone in response to operation performed on a performance operating device, a music searching unit which searches for a musical piece having music data including melody information corresponding to the performance information recorded in the performance recording unit through the music database, a chord judging unit which judges a chord based on the performance information recorded in the performance recording unit, a chord selecting unit which selects one of the chord included in the music data of the musical piece found by the music searching unit and the chord judged by the chord judging unit as the chord to be used, and an automatic accompaniment unit which gives an instruction of generating accompaniment in accordance with the chord selected by the chord selecting unit.

According to another aspect of the invention, the above chord selecting unit compares functional harmonies between the chord included in the music data of the musical piece found by the music searching unit and the chord judged by the chord judging unit, and selects the chord based on the result of the comparison of the functional harmonies.

According to other aspect of the invention, the above chord selecting unit selects the chord judged by the chord judging unit, when the both functional harmonies coincide with each other between the chord included in the music data found by the music searching unit and the chord judged by the chord judging unit, and selects the chord included in the music data, when the both functional harmonies do not coincide with each other.

According to still other aspect of the invention, the chords to be played to a melody performed by a performer are determined automatically based on a melody tone history or are read from the music database. Therefore, appropriate chords to be played can promptly be determined with high accuracy.

BRIEF DESCRIPTION OF THE DRAWINGS

FIG. 12 is a view showing an example of a music database used in the present embodiment of the invention.

FIG. 14 is a view showing an example of a data structure of a melody history recorded in RAM.

FIG. 15 is a view showing an example of F-list of musical pieces prepared in the present embodiment of the invention.

FIG. 16A is a view showing an example of a melody history entered in the present embodiment of the invention.

FIG. 16B is a view showing an example of K-list of musical pieces prepared in the present embodiment of the invention.

FIG. 17A is a view showing an example of a melody history entered in the present embodiment of the invention.

FIG. 17B is a view showing an example of N-list of musical pieces prepared in the present embodiment of the invention.

FIG. 18A is a view showing an example of a melody history entered in the present embodiment of the invention.

FIG. 18B is a view showing an example of N-list of musical pieces prepared in the present embodiment of the invention.

FIG. 18C is a view showing an example of D-list of musical pieces prepared in the present embodiment of the invention.

FIG. 19 is a view showing an example of a general list of musical pieces prepared in the present embodiment of the invention.

FIG. 20 is a view showing an example of a diatonic register used in the present embodiment of the invention.

FIG. 21 is a view showing an example of a diatonic scale table used in the present embodiment of the invention.

FIG. 22 is a view showing an example of an assumed-chord determining map used in the present embodiment of the invention.

FIG. 23 is a view showing an example of a chord database used in the present embodiment of the invention.

FIG. 24 is a view showing an example of a chord judging table used in the present embodiment of the invention.

DETAILED DESCRIPTION OF THE PREFERRED EMBODIMENTS

Figure 1:
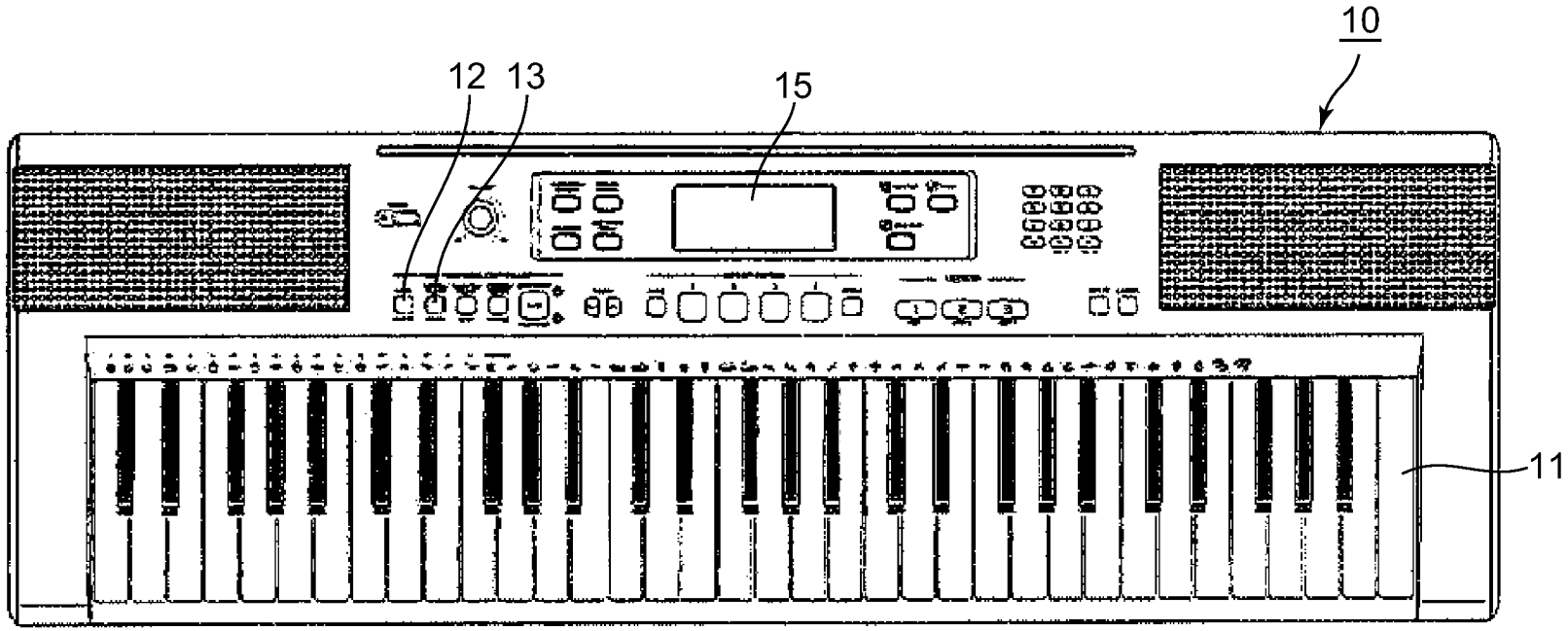
FIG. 1 is a view showing an external appearance of an electronic musical instrument according to the present embodiment of the invention.

Now, the preferred embodiments of the present invention will be described with reference to the accompanying drawings in detail. FIG. 1 is a view showing an external appearance of an electronic musical instrument according to the present embodiment of the invention. As shown in FIG. 1, the electronic musical instrument 10 according to the present embodiment of the invention has a keyboard 11 or a set of adjacent keys used to play the instrument 10. On the upper side of the keyboard 11, there are provided switches 12, 13 and a displaying unit 15. The switches 12, 13 are used to designate tone colors and/or rhythm patterns, and also to give an instruction of starting and/or finishing automated musical accompaniment. The displaying unit 15 is used to display various sorts of information of music to be played, such as tone colors, rhythm patterns, and chord names. The electronic musical instrument 10 according to the present embodiment of the invention has, for example, 16 pieces of keys (C2 to C7). In the electronic musical instrument 10, there are prepared two performance modes: (1) an automatic-accompaniment mode for providing automated musical accompaniment; and (2) a normal mode for providing no musical accompaniment. The electronic musical instrument 10 can be played either in the automatic-accompaniment mode or in the normal mode.

Figure 2:
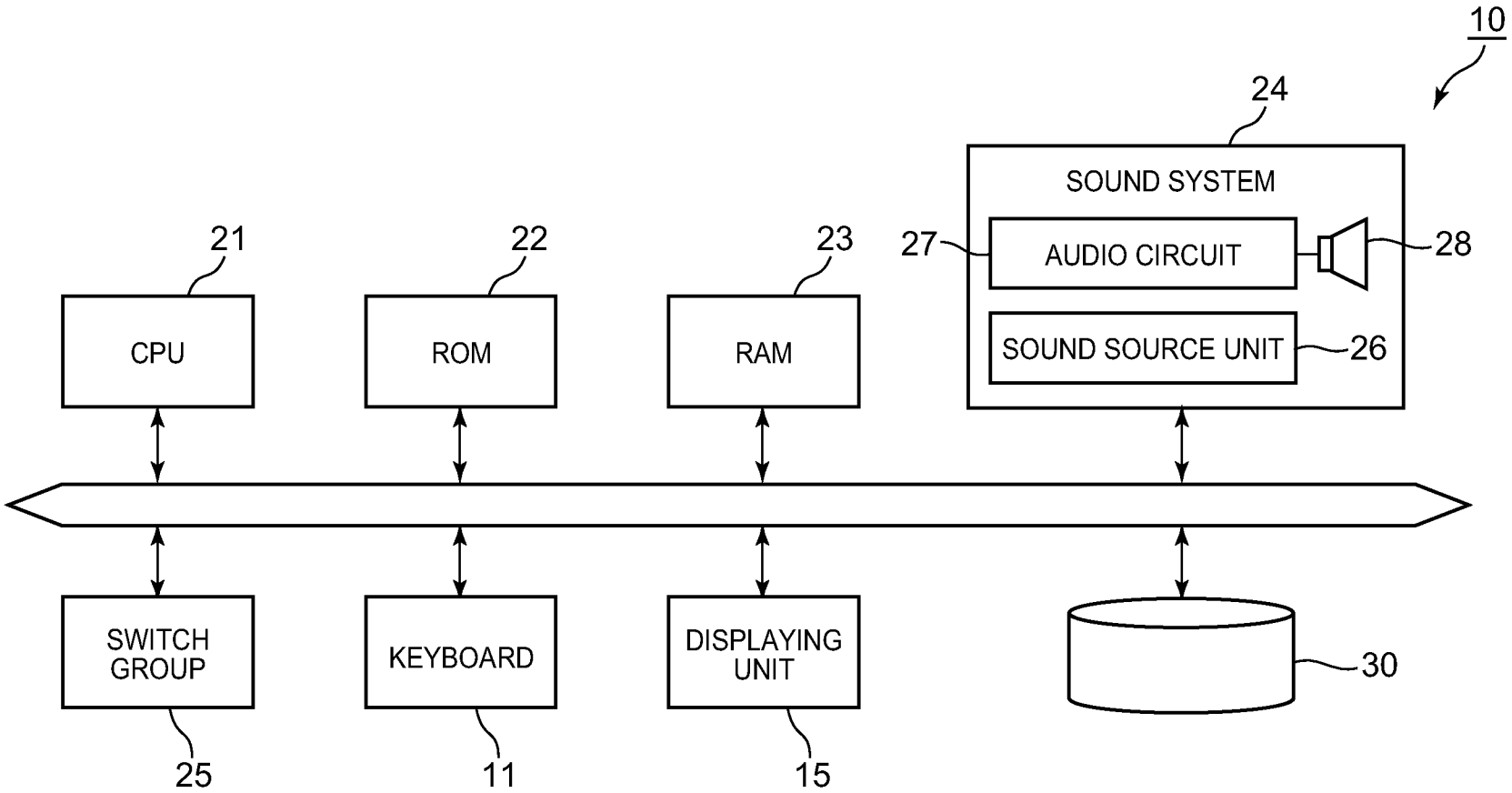
FIG. 2 is a block diagram showing a circuit configuration of the electronic musical instrument according to the present embodiment of the invention.

FIG. 2 is a block diagram showing a circuit configuration of the electronic musical instrument 10 according to the present embodiment of the invention. As shown in FIG. 2, the electronic musical instrument 10 is provided with CPU 21, ROM 22, RAM 23, a sound system 24, a switch group 25, the keyboard 15 and the displaying unit 15.

CPU 21 controls the whole operation of the electronic musical instrument 10, and further performs various processes, such as detecting pressed keys of the keyboard 11, detecting operated switches (for example, 12, 13 in FIG. 1) composing the switch group 25, controlling the sound system 24 in accordance with the detected pressed keys and the detected operated switches, deciding the chord names depending on the pitches of the musical tones of pressed keys, and providing automated musical accompaniment in accordance with automated accompaniment patterns and chord names.

ROM 22 stores programs for the processes to be performed by CPU 21 such as processes to be performed in accordance with the operated switch or in response to the pressed keys, generating musical tones in response to the pressed keys, deciding the chord names depending on the pitches of the musical tones of the pressed keys, and providing musical accompaniment in accordance with the automated accompaniment patterns and chord names. Further, ROM 22 has a waveform-data area, which stores waveform data for generating various sorts of musical tones such as the pianos, guitars, bass drums, snare drums and cymbals, and an automatic-accompaniment pattern area, which stores data (automatic accompaniment data) indicating various automatic accompaniment patterns.

RAM 23 stores the program read from ROM 23 and data produced in the various processes. Further, RAM 23 stores melody history data which is produced by CPU 21 in response to key-pressing and/or key-releasing operations performed on the keyboard 11. In the present embodiment of the invention, the automated accompaniment pattern contains an automated melody accompaniment pattern including melody tones and obbligato tones, an automated chord accompaniment pattern including chord names and composing tones of each chord, and rhythm patterns including drum sounds. For example, a record of data of automated melody accompaniment pattern contains tone colors, pitches, generation timings, and note values of musical tones. A record of data of automated chord accompaniment pattern includes data indicating chord composing tones in addition to the above information. Further, a record of data of rhythm patterns includes tone colors and generation timings of musical tones.

The sound system 24 comprises a sound source unit 26, an audio circuit 27 and a speaker 28. Upon receipt of information of the pressed key or information of the automated accompaniment patterns from CPU 21, the sound source unit 26 reads predetermined waveform data from the waveform-data area of ROM 22 to generate and output musical-tone data of predetermined pitches. Further, the sound source unit 26 can output waveform data, in particular, waveform data of tone colors of percussion instruments such as the snare drums, buss drums, and cymbals as musical-tone data without any modification, too. The audio circuit 27 converts the musical-tone data into an analog signal, and amplifies the analog signal, whereby the analog signal is output from the speaker 28.

Further, the electronic musical instrument 10 according to the present embodiment of the invention is provided with a music database 30. The music database 30 is used as a dictionary, in which a history of an entered melody is compared with musical pieces registered therein to refer to appropriate chords, as will be described later. FIG. 12 is a view showing an example of real data structures in the music database 30.

Figure 13:
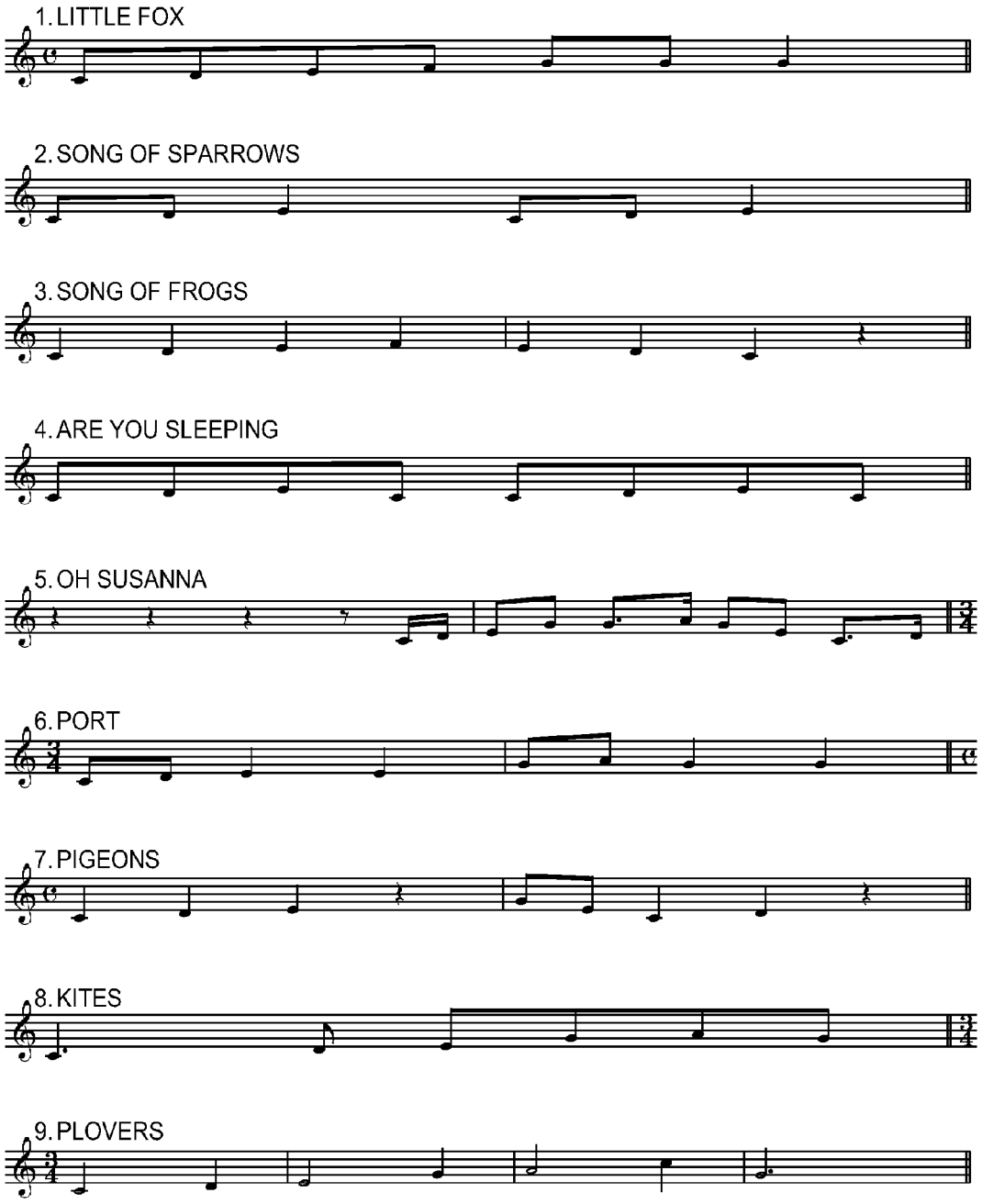
FIG. 13 is a view showing musical scores of musical pieces recorded in the music database of FIG. 12.

FIG. 12 shows for illustrative purposes, leading parts of some musical pieces out of the musical pieces starting with "C-D-E" or "do-re-mi" among various musical pieces registered in the music database. Real musical scores of the music data shown in FIG. 12 for illustrative purposes are shown in FIG. 13. A music database to be read by CPU 21 to use in various processes is written, for example, in a file format of XML (Extensible Markup Language), and is attached with a tag or a header as needed, whereby the database can be confirmed by CPU 21.

As shown in FIG. 12, each music piece is given a music number and a music title in the music database (refer to the columns of music number and music title shown in FIG. 12). Further, as shown in the column (Key/Beats) on the top of each musical piece, a key and beats in which each music piece is recorded are recorded, too. For instance, concerning "Little Fox" of the music number 1, "C/4" is recorded, which represents that this musical piece is recorded in C major and in simple meter. Similarly, "C/3" is recorded in the column of "Port" of the music number 6, which represents that this musical piece is recorded in C major and in triple meter.

Although an example of the music database in which all the musical pieces are recorded in C major is shown in FIG. 12, it is possible to prepare a music database that contains the musical pieces recorded in a unified key other than C major or various musical pieces recorded indifferent keys from each other. In the case of the database in which all the musical pieces are recorded in the same key, when an estimated tonality in which a user plays a melody has been judged by a chording algorithm and/or by a tonality judging algorithm, both to be described later, an interval (number of semitones) between the estimated tonality (judged tonality) and the tonality (C major in FIG. 12) registered in the database is calculated, and all the musical pieces registered in the database are evenly transposed to the judged tonality based on the calculated interval. Meanwhile, it is possible to register plural musical pieces in respective keys in the database, in other words, to register each musical piece in its own original key in the database.

Further, to the right of the column of "Key/Beats" is the column of "Notes" (Note column), where pitches, intervals from the preceding tone, ST ratios to the opening tone (Step Time) of musical tones of a melody and chords to the melody of each musical piece are recorded.

Again, taking the music "Little Fox" of the music number 1 as an example, a detailed description will be given. The melody of the musical piece is given by "Do Re Mi Fa Sol Sol Sol", and therefore, the pitches "C D E F G G G" of the melody of the musical piece of music number 1 are successively recorded on the top in the column of Notes, as shown in FIG. 12.

On the second line in the column of Note of each musical piece in FIG. 12, the intervals from the opening tone/preceding tone and subsequent tone are recorded. In other words, concerning the first tone of the melody, the pitch of the opening tone (C in all the musical pieces shown in FIG. 12) itself is recorded directly, and concerning the second tone and the following, the intervals (difference between two pitches, or number of semitones) from the just preceding tone are recorded. For instance, in the case of "Little Fox" of the music number 1, "C" is directly recorded at the first tone of the melody. Concerning the second tone "D" of the melody, since the second tone "D" is higher than the preceding tone "C" by 2 semitones, then "2" is recorded. Similarly, concerning the third tone "E" of the melody, the interval (number of semitones) "2" between the second tone "D" and the third tone "E" is recorded. Further, concerning the fourth tone "F" of the melody, the interval (number of semitones) "1" between the third tone "E" and the fourth tone "F" is recorded.

As shown in the musical piece of music number 2 and the following musical pieces, when the melody tones are descending, the intervals from the preceding tone are recorded in a negative value. (For example, the fourth tone of "Song of Sparrows" of the music number 2 and the fifth and sixth tones of "Pigeon" of the music number 7 are recorded in a negative value.)

Further, on the third line in the column of Notes of each piece of music in FIG. 2, an item of "ST ratios to the opening tone" is prepared, where ST stands for Step Time. ST indicates a value representing a time duration from a generation timing of a tone to the generation timing of the following tone. Therefore, in the item of "ST ratio to the opening tone" of the music database, data representing a ratio of ST of the opening tone (the first tone) of the melody to ST of the following notes is recorded.

In the database shown in FIG. 12, the notes having the same duration as ST of the opening tone are recorded such that "ST ratio to the opening tone" will be "1". Therefore, for instance, all the notes from the second to the sixth tones in the "Little Fox" of the music number 1 are eighth notes (no rest) having the same duration as the opening tone, and therefore, "1" is recorded in the item of "ST ratio to the tone" of these notes. Further, the seventh tone of "Little Fox" of the music number 1 is a quarter note (G) having a double duration of the opening tone (eighth note) and therefore, "2" is recorded in the item of "ST ratio to the tone" of this note. Further, in the music of "Kite" of the music number 8, the opening tone is a dotted quarter note and the notes from the second to the sixth tones are eighth notes having one third duration of the opening tone, and therefore "0.33" is recorded in the item of "ST ratio to the tone" of these notes.

Further in FIG. 2, on the forth line in the column of Note of each musical piece, a column of chords ("chord column") is prepared, in which chord names are recorded. In the chord column, for instance, "C" indicated therein represents the chord "C", that is, "C" represents a chord of "Do Mi Sol". "G7" indicated in the chord column represents a chord "G7" representing a seventh chord of "Sol Si Re Fa". A symbol "→" in the chord column means that the chord is the same as the previous chord, that is, means that the chord is not changed but kept as is. The combinations of the chord names and real sounds are stored, for example, in ROM. The combinations are referred to a table (not shown).

The chord column is referred to determine chords to be played to a melody in a chord selecting process. The chord selecting process will be described later. The chords such as played together with a melody are not always determined as one set of chords but the chords are selected and played by a musician in various ways depending on his/her personality and feeling and on arrangement of music. Meanwhile, in the present embodiments of the invention, from the standpoint of an auxiliary assistance of an automatic chord judgment (automatically playing chords) by a machine in an automatically playing accompaniment, it will be preferable that a table of chords is prepared such that when the chords selected at least from the table are played, no one feels a feeling of strangeness on such chords.

The data format of the musical pieces in the database is not always limited to the one described herein, but data in each item of the database can be calculated from data in MIDI format as follows: "ST ratio to the opening tone" of each note is calculated from a duration of each note of the melody; and pitches of adjacent notes of the melody tones are compared to calculate the "interval" from the just preceding tone to each note. Further, it is possible to prepare chord data containing chords separately. Furthermore, such chord data is practicable too, as recorded on a track separate from a melody track, which chord data contains chord symbols representing chords or plural notes representing chords.

The electronic musical instrument 10 according to the present embodiment of the invention generates musical tones in accordance with the pressed keys of the keyboard 11 in the normal mode. Meanwhile, the electronic musical instrument 10 is switched to the automatic-accompaniment mode, when an automatic accompaniment switch among the various switches 12, 13 shown in FIG. 1 is operated by the user. In the automatic-accompaniment mode, when a key is pressed, a musical tone of a pitch of the pressed key is generated. Further, a chord name is determined based on information of the pressed keys, and musical tones are generated in accordance with an automatic accompaniment pattern including tones composing the chord of the chord name. The automatic accompaniment pattern can include a rhythm pattern of the bus drum, snare drum and cymbal with no pitch variation. Hereinafter, the operation of the electronic musical instrument 10 in the automatic-accompaniment mode will be described.

Figure 3:
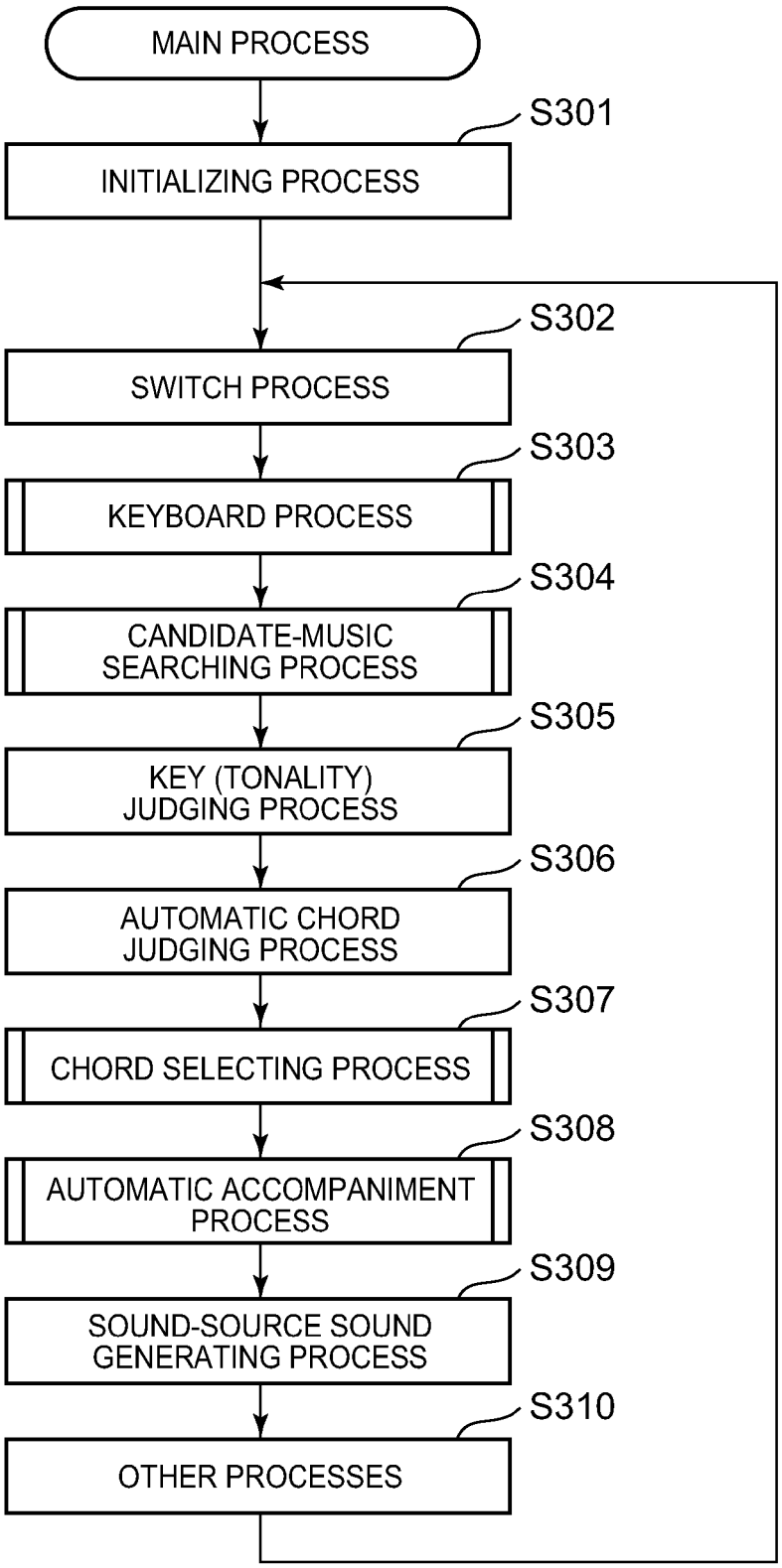
FIG. 3 is a flowchart showing an example of a main process performed in the electronic musical instrument of the present embodiment.

Now, the process to be performed in the electronic musical instrument 10 of the present embodiment of the invention will be described in detail. FIG. 3 is a flow chart showing an example of a main process performed in the electronic musical instrument 10 of the present embodiment. During the course of the main process, a timer incrementing process is performed at intervals to increment a counter value of an interrupting counter (not shown).

As shown in FIG. 3, when the power of the electronic musical instrument 10 is turned on, CPU 21 of the electronic musical instrument 10 performs an initializing process, clearing data in RAM 23 and an image on the displaying unit 15 (step S301). When the initializing process has finished, CPU 21 detects operated switches among the switch group 25 and performs a switch process in accordance with the detected operated switches (step S302).

In the switch process are detected operation of the following switches: a switch of designating a tone color; a switch of designating a sort of the automatic accompaniment pattern; and a switch of designating on/off of the automatic accompaniment pattern (step S302). When the switch of designating the automatic accompaniment pattern is turned on, CPU 21 switches the performance mode to the automatic accompaniment mode. Data indicating the performance mode is designated in a predetermined area of RAM 23. Similarly, data indicating the tone color and data indicating the sort of automatic accompaniment pattern are also stored in a predetermined area of RAM 23.

Figure 4:
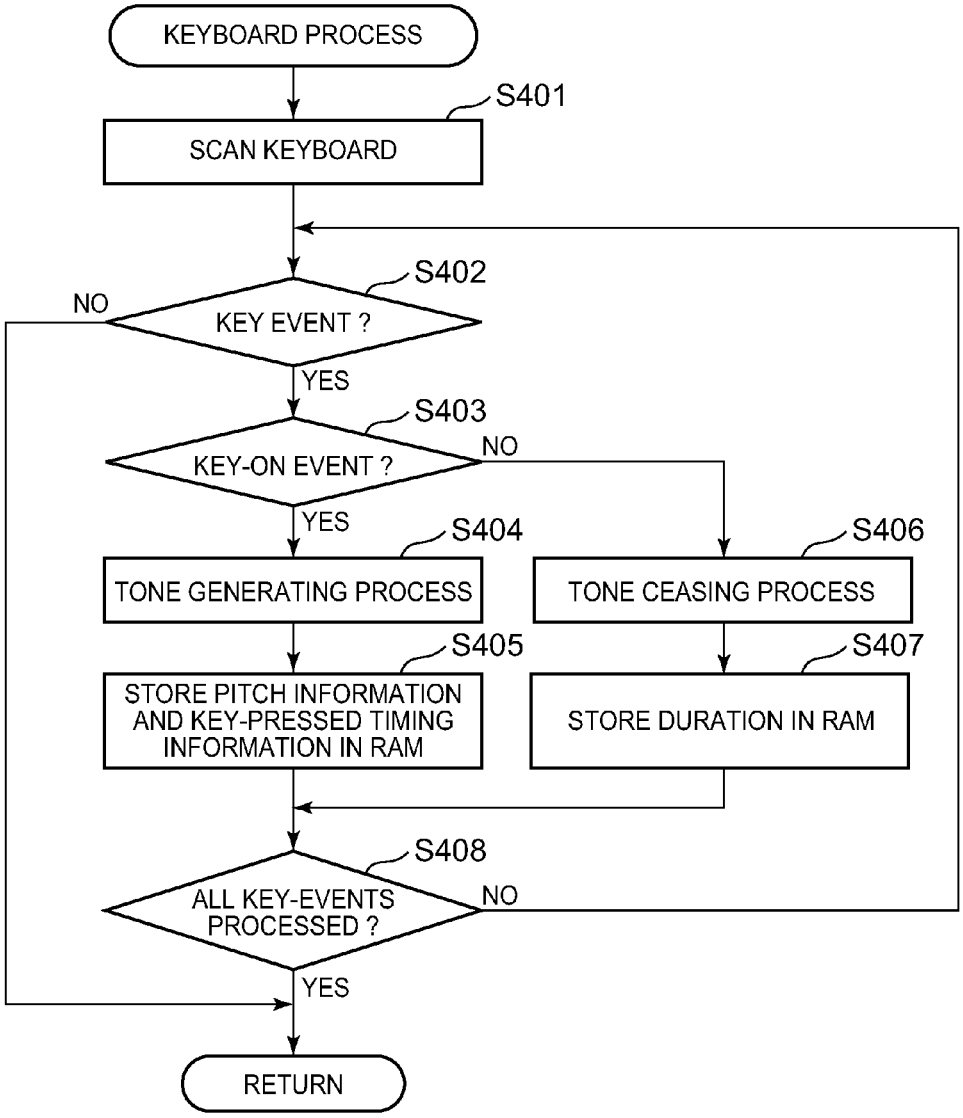
FIG. 4 is a flow chart showing an example of a keyboard process performed in the present embodiment of the invention.

Then, CPU 21 performs a keyboard process (step S303). FIG. 4 is a flow chart showing an example of the keyboard process in the present embodiment of the invention in more detail. In the keyboard process, CPU 21 scans the keys of the keyboard 11 (step S401). An event (key-on or key-off detected as a result of the scanning by CPU 21) is temporarily stored in RAM 23 together with information indicating a time at which the event arises. CPU 21 refers to the result of scanning of the keys stored in RAM 23 to judge whether an event has arisen on a key (step S402). When it is determined YES at step S402, CPU 21 judges whether the event is a key-on (step S403).

When it is determined YES at S403, that is, when it is determined that the event is a key-on (key-on event), CPU 21 performs a tone generating process in accordance with said key (the key-on event) (step S404). In the tone generating process, CPU 21 reads from RAM 23 tone color data and data indicating a pitch of the key designated by the tone color designating switch, and stores the data temporarily in RAM 23. The data indicating tone color and data indicating pitch are supplied to the sound source unit 26 in a sound-source sound generating process (step S309 in FIG. 3) to be described later, and the sound source unit 26 reads waveform data from ROM 22 in accordance with the data indicating tone color and data indicating pitch to generate music data of a predetermined pitch, whereby music is output from the speaker 28.

Thereafter, CPU 21 stores in RAM 23 pitch information (for instance, a key number) of the key-on key and the key-pressed timing at which said key is pressed (for instance, a key-pressed time) (step S405). The key-pressed timing can be counted from the count value of the interrupting counter.

When it is determined NO at step S403, it is determined that the event is a key-off. Then, CPU 21 performs a tone ceasing process in accordance with said key (key-off event) (step S406). In the tone ceasing process, CPU 21 generates data indicating a pitch of a musical tone to be ceased, and stores the data temporarily in RAM 23. In this case, in the sound-source sound generating process (step S309) to be described later, the data indicating tone color of the tone to be ceased and data indicating pitch of the tone to be ceased are supplied to the sound source unit 26. The sound source unit 26 ceases the musical tone in accordance with the supplied data. Thereafter, CPU 21 stores a duration (key-pressed duration) during which the key is kept pressed in RAM 23 (step S407). Further, when a melody history is stored, CPU 21 calculates the ratio of the duration of the present tone (ST ratio to the opening tone) to the opening tone (ST: Step Time), and stores the calculated "ST ratio to the opening tone" together with the melody history information.

CPU 21 judges whether the process has been finished with respect to all the key events (step S408). When it is determined NO at step S408, CPU 21 returns to step S402. When it is determined that the process has been finished with respect to all the key events (YES at step S408), then CPU 21 finishes the keyboard process of FIG. 4.

Figure 5:
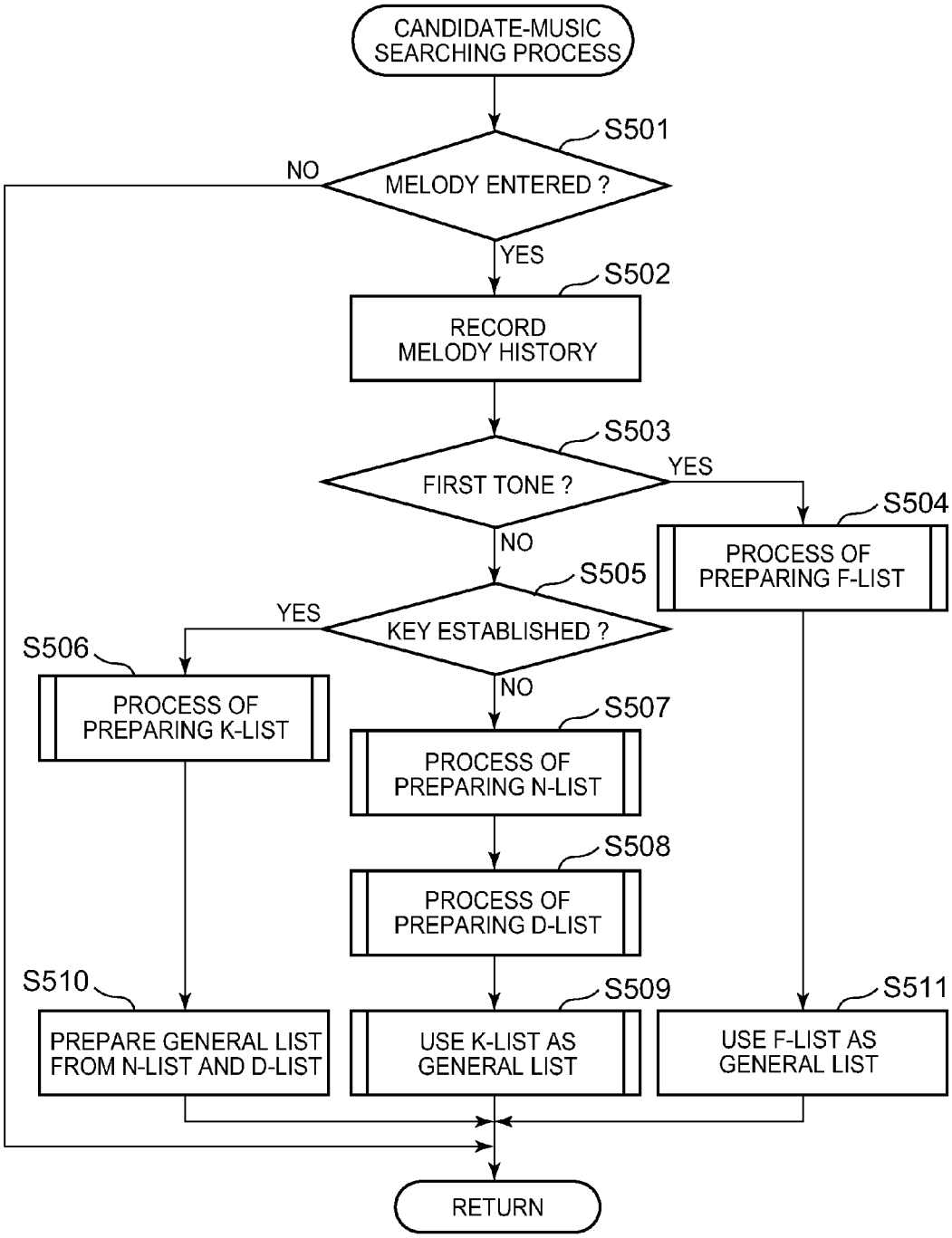
FIG. 5 is a flow chart showing an example of a candidate-music searching process performed in the present embodiment of the invention.

When the keyboard process has finished (step S303 in FIG. 3, the process of FIG. 4), CPU 21 advances to step S304 to perform a candidate-music searching process. FIG. 5 is a flow chart showing an example of the candidate-music searching process in the present embodiment of the invention in more detail.

In the candidate-music searching process, CPU 21 judges whether a melody has been entered in accordance with the key pressing/releasing operation detected in the keyboard process of FIG. 4 (FIG. 5501). When it is determined that no melody has been entered (NO at step S501), CPU 21 finishes the candidate-music searching process of FIG. 5.

When it is determined that a melody has been entered (YES at step S501), CPU 21 records the entered melody as a melody history in a melody-history recording area of RAM 23 in addition to the melody history previously recorded therein (step S502). An example of a data structure of the melody history recorded in RAM is shown in FIG. 14.

In the example shown in FIG. 14, so as to meet the data structure of the music database (FIG. 12), CPU 21 calculates and stores entered pitches, intervals from the just preceding tone (opening tone), and "ST ratios to the opening tone" of the entered melody. The specific meanings and calculating methods of the data in these items are similar to those described with respect to the music database of FIG. 12. If the data structure of the database should be changed, data can be recorded in other data structure so as to meet such changed data structure of the database.

When the melody history is recorded at step S502, it is possible to exclude a tone of an extremely short duration from the tones of the melody history to be recorded, in order to prevent recording a fine touch in error. For example, a tone of a key-pressed duration which is a threshold value or less is not recorded in the melody history recording, and a process of returning from the candidate-music searching process can be performed without performing the processes at step S503 and thereafter.

Figure 6:
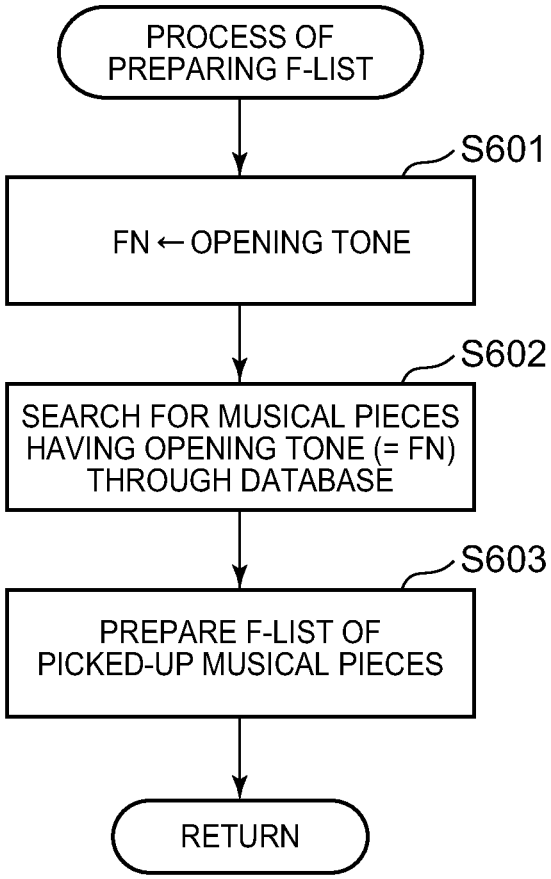
FIG. 6 is a flow chart showing an example of a process of preparing F-list of musical pieces in the present embodiment of the invention.

When the melody-history recording finishes at step S502, CPU 21 judges whether the entered melody tone is the first melody tone (step S503). When it is determined that the entered melody tone is the first melody tone (YES at step S503), CPU 21 performs a process of preparing F-list of musical pieces (step S504). FIG. 6 is a flow chart showing an example of a process of preparing F-list of musical pieces in the present embodiment of the invention in more detail. The process of preparing F-list of musical pieces will be described with reference to the flow chart of FIG. 6.

The F-list of musical pieces prepared in the process of preparing F-list of musical pieces FIG. 6 is a list of musical pieces which are selected from the music database (FIG. 12), whose first melody tone coincides with the entered first melody tone.

Since comparison is made between the entered melody and the musical pieces in the database (FIG. 12) only in terms of the first melody tone, it is not always possible to select only one musical piece. If it is considered that the user can play the music in a transposed key, a really wanted musical piece cannot be always chosen accurately. For instance, assuming that the user often plays a melody in the original key, it will be possible to chose desired musical pieces to some extent by searching in the terms of the first tone of the entered melody through the music database in which musical pieces are recorded in the original key.

In FIG. 6, CPU 21 obtains information of the opening tone, that is, information of the first melody tone as a variable FN (step S601). Then, CPU 21 searches through the database for the registered musical pieces having the opening tone that coincides with the melody tone FN (step S602).

Then, CPU 21 picks up the musical pieces found at step S602 to prepare F-list of musical pieces (step S603). When plural musical pieces have been found at step S603, CPU 21 uses all the found musical pieces to prepares a list of musical pieces, or CPU 21 selects a predetermined number of musical pieces at random and prepares F-list of these selected musical pieces. On the contrary, when no musical piece has been found, it is possible to send a flag of no music found.

An example of the F-list of musical pieces prepared in the above manner is shown in FIG. 15. FIG. 15 shows an example of the F-list of musical pieces which have been found, when the first tone "C" of the entered melody shown in FIG. 14 is entered to search through the music database (FIG. 12 and FIG. 13). The first tone "C" of the entered melody coincides with all the musical pieces from the music number 1 to the music number 9 in the music database, and therefore all the musical pieces from the music number 1 to the music number 9 are included in the F-list of musical pieces.

The order given to the musical pieces is absolutely one example, and the order shown in FIG. 15 indicates the order in which the musical pieces are found in the database and are serially included in the list. In the list shown in FIG. 15, the order numbers are given to the musical pieces, according to which the musical pieces are read from the music database and are stored in the list in order. In other case, it is possible that all plural musical pieces are given the same order number.

When the F-list of musical pieces (FIG. 6) has been prepared at step S504 in FIG. 5, CPU 21 uses the F-list of musical pieces as a general list (step S511), finishing the candidate-music searching process.

Meanwhile, when it is determined that the entered melody tone is not the first melody tone (NO at step S503), CPU 21 judges whether a key (tonality) of the entered melody has been established (step S505).

The judgment of whether a key (tonality) of the entered melody has been established (step S505) can be made in a key (tonality) judging process (step S305 in FIG. 3). In the key (tonality) judging process, it is judged whether a key has been established as an "established key". The key judging process will be described in detail later.

Figure 7:
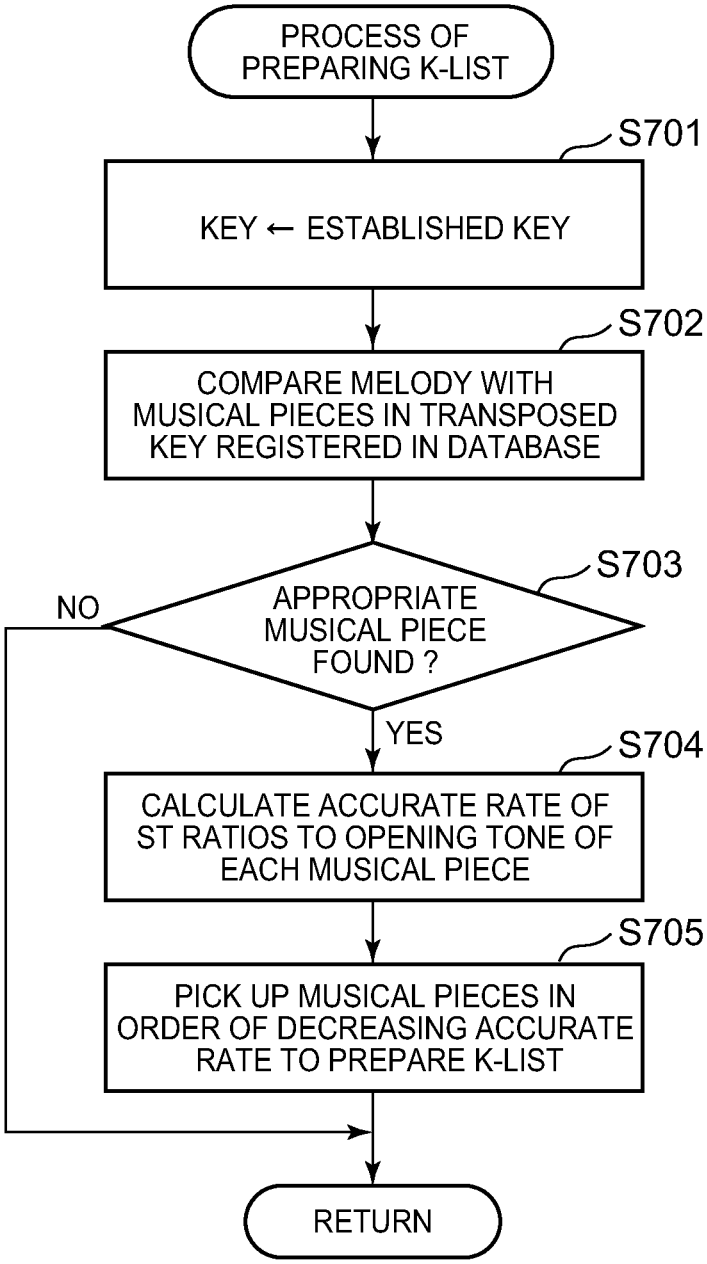
FIG. 7 is a flow chart showing an example of a process of preparing K-list of musical pieces in the present embodiment of the invention.

When it is determined that the key (tonality) of the entered melody has been established (YES step S505), CPU 21 prepares K-list of musical pieces at step S506. A process of preparing K-list of musical pieces is shown in FIG. 7 in detail. The process of preparing K-list of musical pieces will be described with reference to the flow chart of FIG. 7.

The K-list of musical pieces to be prepared in the process of preparing K-list of musical pieces of FIG. 7 will be described. On the basis of the determination that the key (tonality) of the entered melody has been established, the musical pieces recorded in the music database (FIG. 12) are transposed to the keys (tonality) determined to have been established, and then the entered melody history is compared with the musical pieces in the database to prepare K-list of musical pieces.

With the above processes prepared, even if the user plays THE melody in a key arbitrarily transposed by the user, the musical piece can be searched for and specified promptly regardless of the key (tonality) of the musical piece registered in the music database, whereby correct chords will be generated.

In the process of preparing K-list of musical pieces, CPU 21 obtains information of the key of the entered melody, which key is determined to be established, as a variable Key (step S701). Then, CPU 21 compares the established key (variable Key) of the entered melody with the keys (tonalities) of the musical pieces recorded in the music database (FIG. 12) (step S702).

The process of preparing K-list of musical pieces will be described more specifically. For example, assuming that the established Key of the entered melody "F major" has been obtained as the variable Key, when the music "Are you sleeping" of the registered Key "C" of the music number 4 is compared with the entered melody of the variable Key "F", then the number of semitones between the registered Key "C" and the established Key (variable Key) "F" is calculated. According to the known music theory, the "number of semitones is 5" can be calculated. Each tone of the registered melody of "Are you sleeping" of the music number 4 is subjected to a process of "number of semitones+5" to transpose the key to F major. In the case of the music "Are you sleeping", the original melody "C D E C C D E" is subjected to modulation of "number of semitones+5", and will be "F G A F F G A".

Then, melodies of key-transposed musical pieces in the music database are compared with the previously entered melody history on a tone to tone basis. As a result of the comparison, musical pieces which meet predetermined conditions are picked up at step S702.

Various conditions will be considered for picking up the musical pieces. For instance, a musical piece can be picked up from the music database, whose tones from the initial to the latest tones coincide in pitch with those of the entered melody history. Further, it is possible to pick up a predetermined number of musical pieces in order of decreasing number of coincident tones from among musical pieces including larger number of tones which are continuously coincident from past tones to current tones of the entered melody history. Furthermore, it will also be possible to pick up a predetermined number of musical pieces in order of decreasing number (probability) of coincident tones from among musical pieces including number of coincident tones from the initial tones to the current tones.

Then, CPU 21 judges whether any musical piece has been picked up (step S703). When it is determined that no musical piece has been picked up (NO at step S703), then CPU 21 finished the process of preparing K-list of musical pieces.

When it is determined that musical pieces have been picked up (YES at step S703), "ST ratio to the melody opening tone (the first tone)" of each tone of the entered melody history is calculated. The calculated ST ratios to the melody opening tone (the first tone) of the entered melody history are compared with "ST ratios to the opening tone" of the picked up musical pieces, recorded in the music database, whereby an "accuracy rate" will be calculated (step S704).

To calculate the "accuracy rate" (step S704), various methods will be used.

For instance, the "accuracy rate" will be calculated according to one method, that is, "ST ratio to the melody opening tone" of each tone of the entered melody history is calculated and the accuracy rate of each tone is determined based on difference between the calculated ST ratios of the entered melody and ST ratios registered in the music database, and then average of the determined accuracy rates is calculated. In other words, for instance, concerning "D" of the second tone of the music "Are you sleeping" of the music number 4, "ST ratio"="1" is recorded in the music data base, which means that "D" of the second tone of the music has the same duration as the opening tone in the music database. But when a duration of the second tone of the melody actually played by the user is 90% or 110% of the melody opening tone, the accurate rate of the second tone will be "90 points" according to the above method.

As described above, the "accurate rate of a musical piece" can be calculated at step S704, which rate corresponds to an index representing "to what extent a musical piece resembles the entered melody history". A predetermined number of musical pieces are picked up in order of decreasing accurate rate from among musical pieces having a high "accurate rate", and K-list of picked-up musical pieces is prepared (step S705). Then, the process of preparing K-list of musical pieces finishes.

An example of the K-list of musical pieces prepared in the above manner is shown in FIG. 16B.

An example of the K-list of musical pieces is shown in FIG. 16B, which K-list has been prepared upon searching for the musical pieces through the music database shown in FIG. 12 and FIG. 13, when a melody history shown in FIG. 16A is entered.

As shown in FIG. 16A, four tones of the melody are successively entered in the order of "F G A B♭". It is assumed that F major has been established from this entered melody". Further, when it is assumed that the player operates the keyboard to enter the melody, in general, fluctuations and unfaithfulness can be invited to some extent in a human performance. The example of FIG. 16A shows that, upon consideration of these fluctuations and unfaithfulness, "ST ratio to the opening tone" is given "0.9" for the second tone "G", which means that the second tone "G" is pressed for a little shorter duration than "1", and is given "1.1" for the third tone "A", which means that the third tone "A" is pressed for a little longer than "1".

The process of preparing K-list of musical pieces (shown in FIG. 7) will be described, which is performed when the melody described above is entered. The key which has been set to the variable Key, or established, that is, the key "F" is recorded at step S701. Then, the musical pieces in the music database are transposed to the established Key "F", and a "pitch series" is confirmed in the key-transposed musical pieces. In other words, the musical pieces transposed to F major and including pitches "F G A B♭", that is, the musical pieces in C major and having pitches "C D E F" ("pitch series") are searched for through the musical pieces in the music database. In the case, the musical piece "Little Fox" of the music number 1 and the music "Song of Frogs" of the music number 3 include the "pitch series", and are extracted.

When the musical pieces including the pitch series have been extracted (YES at step S704), CPU 21 calculates the "accurate rate" P of ST ratio of each of the extracted musical pieces (step S704). Using an ST value: STdb(i) of the i-th note of the extracted musical piece in the music database and an ST value: STin(i) of the i-th note of the entered melody, the "accurate rate" can be calculated from the following formula (1):

$$\text{accurate rate} = 100 - \left\{ \sum_{i=2}^{n} \left( |STdb(i) - STin(i)| \div STdb(i) \times 100 \right) \right\} \div (n-1) \quad (1)$$

As shown in the formula (1), concerning ST value of each tone, an absolute difference between ST value given by data registered in the music database and ST value of the entered melody is divided by the ST value given by data registered in the music database, whereby a ratio is obtained and converted to percentage. An average of the ratios of the second to the latest tones among the entered tones is calculated, and then the calculated average is subtracted from 100 to obtain the "net accurate rate".

More specifically, when the entered melody shown in FIG. 16A is compared with the musical piece "Little Fox" of the music number 1, the difference in ST value between the both second tones is 0.1. When this difference 0.1 is divided by ST value (=1) of the second tone in the database, then a value 0.1 is obtained and converted to percent (to 10). Similarly, "10" is obtained for the third tone and "0" for the fourth tone. The sum of (10, 10, 0) is calculated to obtain 20.

Then, the average of (10, 10, 0) will be about 6.7. [(10+10+0)/3≈6.7] This average is subtracted from 100 to obtain the "accurate rate"=93.3 points.

In the formula (1), the ST ratio of the first tone is not included in the calculation, because the ST ratio of the first tone is used as the reference and the ST ratio of the first tone will be 100% at all times. Therefore, the ST ratio of the first tone is excluded from the operation of the formula (1).

When the accurate rates of the musical pieces including the "pitch series" have been obtained, the musical pieces of the higher accurate rate are picked up in order of decreasing points to prepare K-list of musical pieces (step S705). In the example of the K-list of musical pieces shown in FIG. 16B, since the music "Little Fox" of the music number 1 and the music "Song of Frogs" of the music number 3 have the same accurate rate 93.3 points, these musical pieces are ranked for convenience in the example of FIG. 16B. Concerning the musical pieces of an even point, it is possible to rank these musical pieces in a similar manner to that described in the process of preparing the F-list of musical pieces.

Once the K-list of musical pieces has been completed (step S506 in FIG. 5, the process of FIG. 7), CPU 21 uses the K-list of musical pieces as the general list (step S510), finishing the candidate music searching process.

Figure 8:
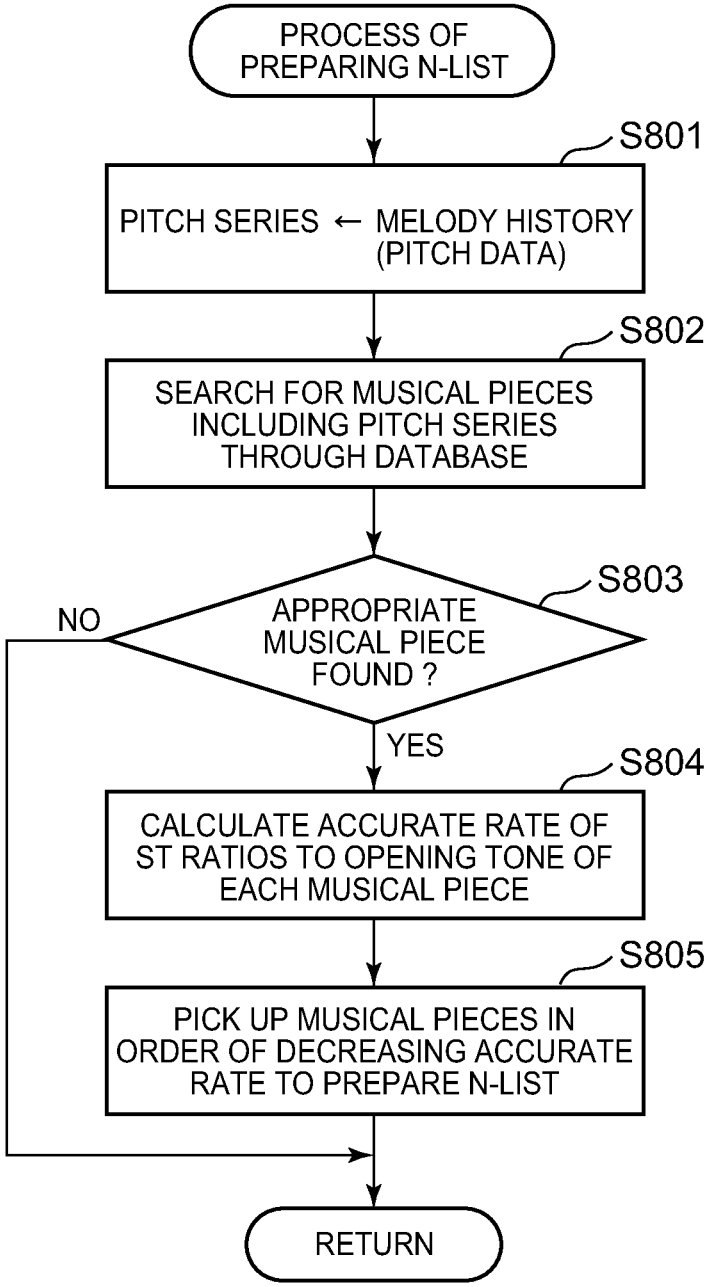
FIG. 8 is a flow chart showing an example of a process of preparing N-list of musical pieces in the present embodiment of the invention.

Meanwhile, when it is determined that the key (tonality) of the entered melody has been not established (NO step S505), CPU 21 prepares N-list of musical pieces at step S507. A process of preparing N-list of musical pieces is shown in FIG. 8 in detail. The process of preparing N-list of musical pieces will be described with reference to the flow chart of FIG. 8.

N-list of musical pieces is prepared upon comparison of the pitches of the entered melody history with the melody pitch data (data given on the top in the Note column) of each musical piece recorded in the music database (FIG. 12).

CPU 21 obtains the melody pitch data of the entered melody history (FIG. 14) as pitch-series data (step S801). When it is assumed that the melody history shown in FIG. 14 is data to be entered and the melody from the first to the third tones has been entered, then data of "C D E" is obtained as the "pitch series" data of the entered melody at step S801.

Then, CPU 21 compares the obtained pitch-series data of the entered melody with the melody pitch data (data on the top in the Note column) of each musical piece in the music database (FIG. 12) to find musical pieces which coincide in pitch with the entered melody (step S802).

For example, in the case that the entered melody is "C D E" as described above, when the music database (FIG. 12) is searched through, all the 9 musical pieces from the music number 1 to the music number 9 shown in FIG. 12 have a melody starting with the pitch series of "C D E". Then, all the 9 musical pieces shown in FIG. 12 are picked up at step S802. In the above mentioned method, the musical pieces whose the first to the latest tones coincide with the pitch-series data are picked up as the result of the searching operation, but various methods of picking up musical pieces can be used at step S802 in a similar manner to that at step S702, where the musical pieces are picked up.

Then, CPU 21 judges whether any musical piece has been picked up at step S802 (step S803). When it is determined that no musical piece has been picked up (NO at step S803), CPU 21 finishes the process of preparing N-list of musical pieces.

Meanwhile, when it is determined that musical pieces have been picked up (YES at step S803), CPU 21 calculates ST ratio to the melody opening tone (first tone) of each tone of the entered melody history, and compares the calculated ST ratios of the entered melody history with "ST ratios to the opening tone" of the picked up musical pieces recorded the music database on a tone to tone basis to calculate the "accurate rate" of the picked up musical pieces (step S804). The specific method of calculating the "accurate rate" is similar to the method as described at step S704.

Referring to the "accurate rates" of the musical pieces calculated at step 804, CPU 21 picks up a predetermined number of musical pieces in order of decreasing accurate rate from among the musical pieces of the higher "accurate rate" to prepare N-list of musical pieces (step S805), finishing the process.

An example of the N-list of musical pieces prepared in the above manner is shown in FIG. 17B.

An example of the N-list of musical pieces is shown in FIG. 17B, which N-list has been prepared upon searching for the musical pieces through the music database shown in FIG. 12 and FIG. 13, when a melody history shown in FIG. 17A is entered.

As shown in FIG. 17A, the entered melody includes three tones "C D E" entered serially. In the example of the entered melody shown in FIG. 17A, it is assumed that all the tones C D E are of an even duration and have the same ST ratio to the first tone (ST value=1).

When the melody (shown in FIG. 17A is entered, the process of preparing N-list of musical pieces is performed. Then, CPU 21 extracts a pitch series of "C D E" from the melody history of FIG. 17A (step S801). Further, CPU 21 compares the pitch series of "C D E" with the musical pieces in the music database of FIG. 12 (step S802). In the present process of preparing N-list of musical pieces, the musical pieces in the music database are compared with no pitches altered, because the key has not been established different from the process of preparing K-list of musical pieces. Therefore, in this case, since all the musical pieces from the music number 1 to the music number 9 have tones from the opening to the third tones of the pitch series of "C D E", all the 9 musical pieces are extracted as the candidate musical pieces at step S802.

Since the musical pieces have been extracted (YES at step S803), CPU 21 calculates the accurate rate of ST ratio: P of each musical piece at step S804. The accurate rate is calculated using the formula (1) in the same manner as at step S704 in the process of preparing K-list of musical pieces.

Taking the music "Kites" of the music number 8 as an example, the calculation of the accurate rate will be described. Since a difference between ST ratio registered in the music database and the ST ratio of the second tone "D" is 0.67, 0.67 is divided by ST ratio registered in the music database (=0.33), whereby about "2" is obtained. (For convenience, 0.33=1/3, and 0.67=2/3.) The value "2" is converted to percentage to obtain "200". Similarly, the percentage of the difference "200" of the third tone is calculated.

The average, (200+200)/2=200 is calculated, and this average is subtracted from 100, whereby the accurate rate −100 is obtained. (In drawings, a symbol "-" is denoted by ▲.)

When the accurate rate of each musical piece has been calculated, the musical pieces are picked up in order of decreasing the accurate rate to prepare N-list of musical pieces at step S805. An example of the N-list of musical pieces prepared in the above manner is shown in FIG. 17B. Some of musical pieces are of even points in the accurate rate, and these musical pieces are ranked in order of increasing music number. It is possible to rank them in other way.

Figure 9:
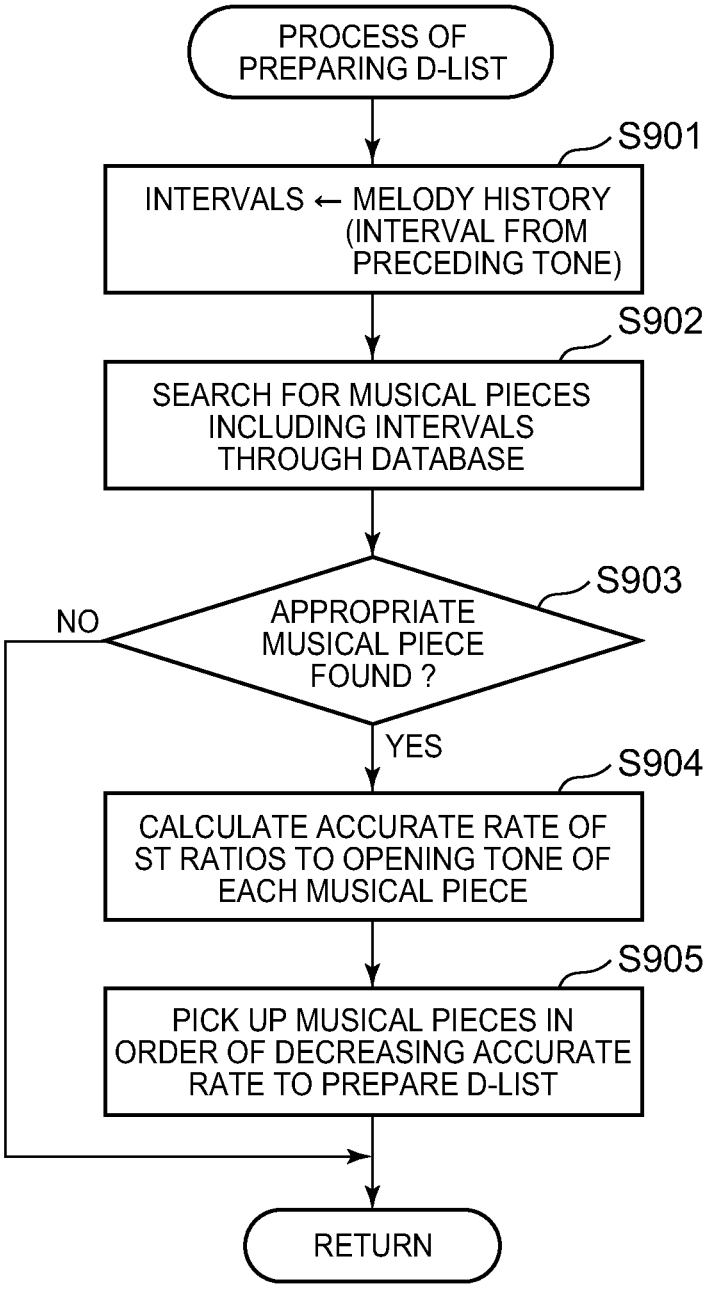
FIG. 9 is a flow chart showing an example of a process of preparing D-list of musical pieces in the present embodiment of the invention.

Once the N-list of musical pieces has been completed (step S507 in FIG. 5, the process of FIG. 8), CPU 21 performs a process of preparing D-list of musical pieces at step S508 in FIG. 5. The process of preparing D-list of musical pieces is shown in FIG. 9 in detail. The process of preparing D-list of musical pieces will be described with reference to a flow chart of FIG. 9.

The D-list of musical pieces prepared in the process of FIG. 9 is used to compare the entered melody history with the melodies registered in the music database in terms of an interval relationship (second line in the Note column).

The N-list of musical pieces prepared in FIG. 8 is used to compare the pitches between the entered melody and the musical pieces registered in the music database. But the D-list of musical pieces prepared in FIG. 9 is used to compare the entered melody history with the melodies registered in the music database in terms of an interval relationship between them. When the D-list of musical pieces is used, even if the entered melody should be played in the transposed key which is different from the key of the melody registered in the music database, the entered music can be compared with the music registered in the music database based on the relative interval relationship between the entered melody and the melody registered in the music database, independently of the tonality of the entered melody.

CPU 21 refers to the data of the entered melody history (FIG. 14) to compare pitches between the adjacent tones, thereby obtaining data (interval-data) of an "interval between the opening/preceding tone and the entered tone" (step S901 in FIG. 9).

For example, assuming that a melody of "F G A" is entered, an interval relationship "2" between the first tone "F" and the second tone "G" will be obtained, and further, an interval relationship "2" between the second tone "G" and the third tone "A" will be obtained.

Then, CPU 21 compares the obtained interval-data of the entered melody with the data of "intervals from the opening/preceding tone" (second line in the Note column) of each musical piece registered in the music database to find musical pieces which coincide in the interval difference with the entered melody (step S902).

The case that the melody of "F G A" is entered will be described as an example. The interval relationship of the entered melody is "2 2" from the first, and concerning the 9 musical pieces registered in the music database (shown in FIG. 12), the interval relationship is "2 2" from the first. Therefore, all the 9 musical pieces shown in FIG. 12 will be picked up at step S902.

In consideration of the effect of D-list of musical pieces, "even in the case where a melody which is transposed to a key different from the key registered in the music database, the musical pieces can be searched for through the music database", the pitch of the opening tone of the entered melody will not be compared with the absolute pitches of the opening tones of musical pieces registered in the music database. When the melody of "F G A" is entered, the pitch "F" of the opening tone of the entered melody and the pitch "C" of the opening tone of each musical piece in the database are different, but in the process of preparing D-list of musical pieces, the pitches of both opening tones are not compared and even if the musical piece has the opening tone of the different pitch, such musical piece will be picked up.

As described above, when the melody of "F G A" is entered, the musical pieces starting with "C D E" will not be picked up in the process of preparing N-list of musical pieces (FIG. 8), because these musical pieces are absolutely different in pitch, but the musical pieces starting with "C D E" will be picked up in the process of preparing D-list of musical pieces (FIG. 9) even though they are different in pitch.

Then, CPU 21 judges whether any musical piece has been picked at step S902 (step S903). When it is determined that no musical piece has been picked up (NO at step S903), CPU 21 finishes the process of preparing D-list of musical pieces.

When it is determined that musical pieces have been picked up (YES at step S903), CPU 21 calculates ST ratio to the melody opening tone (first tone) of each tone of the entered melody history, and compares the calculated ST ratios to the melody opening tone (first tone) of the entered melody history with "ST ratios to the opening tone" of each of the picked up musical pieces registered in the music database on a tone to tone basis to calculate the "accurate rate" of each musical piece (step S904). The specific method of calculating the "accurate rate" is similar to that described at step S704.

CPU 21 refers to the calculated "accurate rates" of the musical pieces, and picks up a predetermined number of musical pieces in order of decreasing accurate rate from among the picked up musical pieces to prepare D-list of musical pieces (step S905), finishing the process.

An example of the D-list of musical pieces prepared in the above manner is shown in FIG. 18C.

An example of the N-list of musical pieces is shown in FIG. 18B, and the example of the D-list of musical pieces is shown in FIG. 18C, both lists being prepared upon searching for musical pieces through the music database shown in FIG. 12 and FIG. 13, when a melody history shown in FIG. 18A is entered.

As shown in FIG. 18A, the entered melody includes 3 tones "F G A". In the example of the entered melody shown in FIG. 18A, it is assumed that all the tones F G A are of an even duration and have the same ST ratio to the first tone (ST value=1).

As described above, when the melody of FIG. 18A is entered, the pitch series is compared with the music pieces in the music database of FIG. 12. But since no musical piece starts with "F G A", no musical piece is picked up from among the musical pieces from the music number 1 to the music number 9 (FIG. 12) in the process of preparing N-list of musical pieces. If another musical piece starting with "F G A" is registered in the music database, then this another musical piece will be picked up in the process and included in the N-list of musical pieces shown in FIG. 18B.

When the entered melody described above is subjected to the process of preparing D-list of musical pieces (FIG. 9), interval-data, that is, the interval "2" between the first tone (opening tone) and the second tone and the interval "2" between the second tone and the third tone are extracted from the melody history data of FIG. 18A (step S901). Then, the interval difference of each musical piece in the music database (FIG. 12) is compared with the extracted interval-data (step S902).

In the process of preparing D-list of musical pieces (FIG. 9), the interval difference is compared instead of the "pitch series", which is compared in the process of preparing N-list of musical pieces (FIG. 8). Therefore, even though the entered melody should be played in a transposed key which is different from the key of the melody registered in the music database, using the relative interval relationship registered in the music database, comparison can be made, whereby musical pieces which have not been picked up for N-list can be picked up for D-list.

For the entered melody of FIG. 18A, since the interval between the first tone (opening tone) and the second tone is "2" and the interval between the second tone (opening tone) and the third tone is "2" in all the 9 musical pieces from the music number 1 to the music number 9 shown in FIG. 12, all the musical pieces are extracted as the candidate musical piece at step S902.

When the musical pieces have been picked up at step S903 (YES at step S903), then CPU 21 calculates the accurate rate: P of ST ratios of each of the extracted musical pieces at step S904. The accurate rate: P is calculated using the formula (1) in a similar manner to the calculation in K-list of musical pieces at step S704 and in N-list of musical pieces at step S804.

When the accurate rate of each of the extracted musical pieces has been calculated, a predetermined number of musical pieces are selected in order of decreasing accurate rate from among the extracted musical pieces to prepare D-list of musical pieces. An example of the D-list of musical pieces prepared in the above manner is shown in FIG. 18C. Some of musical pieces are of even points in the accurate rate, and these musical pieces are ranked in order of increasing music number. It is possible to rank them in other way.

Figure 10:
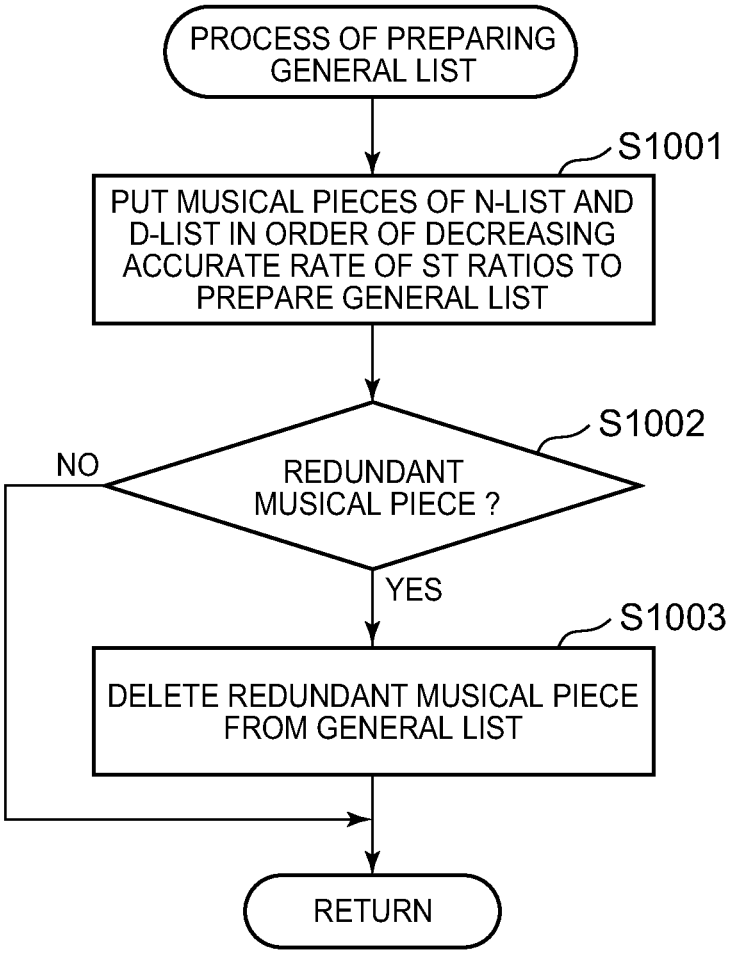
FIG. 10 is a flow chart showing an example of a process of preparing general list of musical pieces in the present embodiment of the invention.

Once the D-list of musical pieces has been completed (step S508 in FIG. 5, the process of FIG. 9), using the N-list of musical pieces (step S507) and D-list of musical pieces (step S508), CPU 21 prepares a general list at step S509 in FIG. 5. A process of preparing the general list is shown in FIG. 10 in detail. The process of preparing the general list will be described with reference to the flow chart of FIG. 10.

In the process shown in FIG. 10, the N-list of musical pieces and the D-list of musical pieces are combined and the musical pieces are put in some order by a certain method to prepare the general list of musical pieces (step S1001)

As the method of combining and putting the musical pieces in order is used a method of putting the musical pieces out of the musical pieces both in the N-list and the D-list in order of decreasing accurate rate of ST ratios calculated at step S804 and step 904.

Further, a method can be used, of putting the musical pieces out of both the N-list and the D-list in order of decreasing number of coincident tones, in the case that when the pitch series or the intervals is compared at step S802 or step 902, the tones of the musical pieces in the music database coincide with the entered melody history in the pitch series or the interval.

Furthermore, upon comprehensively evaluating the result of comparison of the pitch series or interval and the accurate rate of ST ratios, it is possible to use a method of combining the musical pieces of both the N-list and the D-list. In this case, for example, a method can be used, of putting the musical pieces in order of decreasing number of coincident tones among the musical pieces including tones which coincide either in the pitch series or in intervals with those of the entered melody history, and further ranking the musical pieces including even coincident tones in decreasing order of the accurate rate of ST ratios. On the contrary, a method of ranking the musical pieces in decreasing order of the accurate rate of ST ratios on a priority basis can be used, and further a method can be used, of giving a predetermined weights to evaluations of the pitch series and the intervals and summing the weighted evaluations of both items, and then ranking the musical pieces in order of decreasing weighted evaluation.

Once the general list of musical pieces has been created from the N-list of musical pieces and the D-list of musical pieces, CPU 21 searches for a redundant musical piece through the general list of musical pieces (step S1002). This is equivalent to operation of searching for a redundant musical piece through the N-list of musical pieces and the D-list of musical pieces.

When it is determined that a redundant musical piece has been found (YES at step S1002), CPU 21 deletes the redundant musical piece from the general list because such music piece can disturb the following process to be performed. If plural redundant musical pieces should be found, they will be all deleted.

An example of the general list of musical pieces produced from the N-list of musical pieces and the D-list of musical pieces is shown in FIG. 19. In the general list of musical pieces of FIG. 19, the musical pieces are arranged in decreasing order of accuracy rate with a redundant musical piece deleted.

As described above, in the candidate music searching process shown in FIG. 5 the general list of candidate music pieces is produced in accordance with a key (tonality) judging process to be described later, based on the entered melody.

When the candidate music searching process has finished (step S304 in FIG. 3, the process shown in FIG. 5), CPU 21 performs the key (tonality) judging process at step S305 in FIG. 5. The key (tonality) judging process is performed upon updating data of a diatonic register 2000 (FIG. 20) in RAM 23.

In the present embodiment of the invention, CPU 21 stores values in respective items of the diatonic register 2000 every time a melody tone is entered or every time a key is pressed. In the example shown in FIG. 20, a series of values is stored with respect to each of 5 melody tones (reference numerals 2001 to 2005). In FIG. 20, an arrow "t" indicates a time flow, and shows that the key is pressed in order of "C", "D", "E", "F", and "B", indicated in an item of melody tones.

In the present embodiment of the invention, CPU 21 stores values of the following items (to described later) of plural melody tones respectively in unit registers 2001 to 2005 of the diatonic register 2000. The unit registers 2001 to 2005 each have items such as a melody tone, duration, assumed key, assumed chord, assumed function, melody tone history, key candidate register and fixed key. The unit register has values stored respectively in these items. In the item of melody tone is stored the tone name of a pressed key. In the item of duration is stored a duration while the key is kept pressed. It is possible to store ST value in the item of duration in conformity with the music database.

When a key (tonality) has been finally fixed, CPU 21 stores the key name of the fixed key in the item of fixed key (for example, in the unit register 2005 in FIG. 20). But CPU 21 needs that the key is pressed several times before it comes to confirm that the key has been fixed. Therefore, in the present embodiment CPU 21 performs a process to specify assumed keys and stores the names of the assumed keys in the item of assumed key of the unit register, before CPU 21 comes to fix the key. Once the name of the assumed key is stored in the item of assumed key, an assumed chord name appropriate for a melody tone is stored in the item of assumed chord. In the item of assumed function are stored functions of the assumed chord (chord name in the keynote I, and Tonic (T), Dominant (D) or Subdominant (S)).

In the item of melody-tone history are accumulated pitch names of pressed keys from the beginning of a performance or from a predetermined timing. For example, in the item of melody-tone history of the unit register 2001 is stored only "C" of the first pressed key, and in the item of melody-tone history of the unit register 2002 is stored the first pressed key "C" and the following pressed key "D", in other words, two pressed keys "C" and "D" are stored. In the item of key candidate register is stored one possible key name or more at the time when the key is pressed.

To narrow down from the melody history data to a candidate key (tonality), CPU 21 refers to a diatonic scale table 2100 shown in FIG. 21.

In the diatonic scale table 2100, 12 keys, C to B, have key scale notes stored in an easily-discernible manner. For example, for the key "C", the note names C, D, E, F, G, A, B are stored in the diatonic scale table 2100 (refer to a reference numeral: 2101) and for the key "G", the note names G, A, B, C, D, E, F♯ are stored therein (refer to a reference numeral: 2102).

CPU 21 compares the melody-tone history of FIG. 20 with the diatonic scale table 2100 of FIG. 21 to confirm whether any key is found in the diatonic scale table 2100, for which key all the note names included in the melody-tone history are stored in the diatonic scale table 2100. Such key cannot be found in the diatonic scale table 2100, or plural keys can be found. For example, in the melody-tone history of the unit register 2003 (FIG. 20), note names C, D, E are stored. Referring to the diatonic scale table 2100 of FIG. 21, it will be understood that the keys of the diatonic scale containing all note names C, D, E are the keys C, G, F. Therefore, in this case, three keys C, D, E will be the candidate keys (refer to the item of key candidate register in the unit register 2003).

When the candidate keys (tonality) are limited to one, CPU 21 decides the candidate key as the fixed key (tonality). Meanwhile, when there are two candidate keys or more, CPU 21 selects the candidate key having the least number of key signatures among them as an assumed key and stored the assumed key in the item of assumed key in the unit register. In the case of even number of key signatures, for example in the case of F and G or D and B♭, a key in major will be selected as the assumed key in priority.

When the key (tonality) judging process has finished as described above (step S305 in FIG. 3), CPU 21 advances to step S306 to perform an automatic chord judging process.

The automatic chord judging process is performed to automatically decide chords which are to be played to the current melody tones, based on the melody tones which have been entered until now. There are various methods of deciding such chords.

For example, using an assumed-chord determining map 2200 shown in FIG. 22, it is possible to determine chords based on the current melody tone. This method can be used in the case where an adequate melody history has not been obtained and/or just the first tone or only several tones after the opening tone have entered.

In particular, in the case where a key (tonality) has not yet been established, using this method it is possible to determine chords based on chord database shown in FIG. 23. As shown in FIG. 23, chord composing tones and chord scale notes of each chord are stored in the chord database 2300. In the chord database 2300, hatched note names are the chord composing tones.

For example, CPU 21 selects a predetermined number of tones in decreasing order of duration from among tones in a predetermined duration of melody history. It can be previously determined that the predetermined duration of melody history is a melody history consisting of predetermined number of measures or a melody history containing a predetermined number of tones.

CPU 21 compares the predetermined number of tones selected in decreasing order of duration with the chord database 2300 to judge whether any chord is found in the chord database 2300, which chord consists of the chord composing tones including the predetermined number of tones. When it is determined that such chord is found in the chord database 2300, CPU 21 determines that said chord is to be played to the current melody. When it is determined that no chord is found, CPU 21 decreases the number of tones to be selected and refers to the chord database again, and tries to determine a chord again.

Using a chord judging table 2400 shown in FIG. 24, it is possible to determine a chord in accordance with functions of the previous chords and the next progression of the melody.

The functions of the chords are tonic (TO), subdominant (SU), and dominant (DO) in Music Theory. The previous chord functions are indicated in the leftmost column of the table shown in FIG. 24.

In the chord judging table 2400 shown in FIG. 24, a chord can be read from the previous chord function (either tonic (TO), subdominant (SU), or dominant (DO)) and a combination of the previous melody tone (PM) and current melody tone (CM). The chord judging table 2400 shown in FIG. 24 is prepared for the key of C major. In case of a key other than C major, an interval between "C" and the keynote in said key is calculated, and the actual previous melody tone (PM) and actual current melody tone (CM) which are transposed to "C" in consideration of the calculated interval, are used. Although not shown in FIG. 24, depending on the combination of the previous melody tone (PM) and current melody tone (CM), sometimes a chord cannot be obtained from the chord judging table 2400.

Further, using other methods in the public domain, it is possible to perform the key (tonality) judging process of step 305 and the automatic chord judging process of step S306 in FIG. 3. For example, methods disclosed in Japanese Unexamined Patent Publication No. 2011-158855 and Japanese Unexamined Patent Publication No. 2012-68548 can be used.

Figure 11:
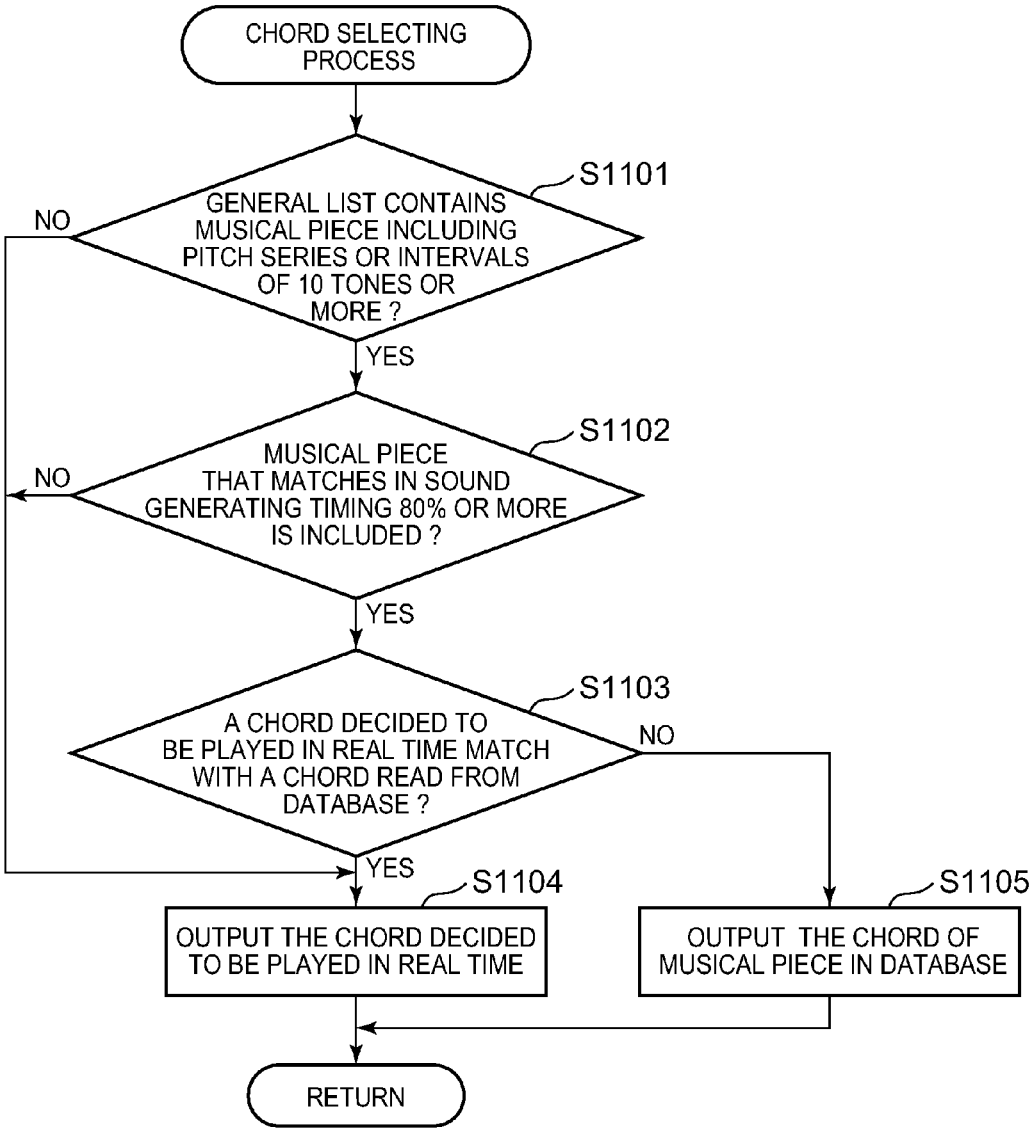
FIG. 11 is a flow chart showing an example of a chord selecting process in the present embodiment of the invention.

When the automatic chord judging process has finished as described above (step S306 in FIG. 3), CPU 21 advances to step S307 to perform a chord selecting process. The chord selecting process is shown in FIG. 11 in detail. The chord selecting process will be described with reference to a flow chart of FIG. 11.

The chord selecting process of FIG. 11 is performed to decide which is to be used for the purpose of playing accompaniment automatically, (1) a progression of chords together with the musical pieces picked up in the candidate-music searching process (step S304 in FIG. 3, the process shown in FIG. 5), or (2) chords decided in the automatic chord judging process (S306 in FIG. 3).

CPU 21 judges whether the general list contains a musical piece including the coincident pitch/interval series of a predetermined number of tones or more (for instance, 10 tones) of (step S1101 in FIG. 11). According to "ONGAKU THEME JITEN" (Music Theme Dictionary) published by ONGAKU NO TOMOSHA CORP., using a sequence of up to 6 tones, a music piece can be located. When music pieces are searched for, using the sequence of up to 6 tones, sometimes around 10 pieces of music having the same tones are located. Therefore, when it is studied whether the searching for music pieces with 6 to 10 tones is proper or not, it has been found that the searching with 6 to 10 tones will bring the result with accuracy to some extent. When the melody has not yet been entered up to a predetermined number of tones (for example, 10 tones), it is possible to skip the present process.

When no music piece including the coincident pitch/interval series of a predetermined number of tones or more has been located in the general list (NO at step S1101), CPU 21 outputs a chord decided to be played in real time (step S1104), finishing the present chord selecting process. When the musical piece is not located in the F-list of musical pieces, K-list of musical pieces and N-list•D-list of musical pieces at all, and has not been picked up in the general list, it is determined NO at step 1101 and CPU 21 outputs a chord determined to be played in real time at step S1104.

Meanwhile, when music pieces including the coincident pitch/interval series of a predetermined number of tones or more have been located in the general list (YES at step S1101), CPU judges whether the musical pieces which match in sound generating timing 80% or more are included in the located musical pieces (step S1102). More specifically, it is judged at step S1102 whether musical pieces of the "accurate rate" of 80% or more are located in the general list. As described above, the "accurate rate" of 80% or more is an evaluation value concerning a sound-generation timing, decided upon comparison of "ST ratios to the opening tone" between the music database and the entered melody history. Therefore, selecting the musical pieces of a predetermined "accurate rate" or more, it will be possible to determine that the user is now playing the same musical piece as the musical piece registered in the music database and it will make no trouble to select the progression of chords from the music database to play chords for the automatic accompaniment. The "accurate rate" of 80% or more can be changed as needed. It is possible to provide a button (not shown) concerning a "leaning level" and to change the reference for judgment according to the leaning level.

When it is determined that no musical piece which matched in sound generating timing 80% or more is found (NO at step S1102), CPU 21 outputs the chord decided to be played in real time (step 1104), finishing the chord selecting process.

Meanwhile, when it is determined that a musical piece which matched in sound generating timing 80% or more is found (YES at step S1102), CPU 21 refers to the music database (FIG. 12) of the musical piece(s) (hereinafter, referred to as the "applicable musical piece (s)") selected at step S1101 and at step S1102, more specifically, the musical piece(s) which includes the coincident pitch/interval series of a predetermined number of tones or more and further matches in sound generating timing 80% or more. Further, CPU 21 reads from the music database, a chord for portions of the data of the applicable musical piece (s), which portions are estimated to correspond to the current melody and judges whether said chord for the portions match with the chord decided to be played in the automatic chord judging process at step S306 (chord decided to be played in real time) (step S1103).

When the chord decided to be played in the automatic chord judging process (chord decided to be played in real time) match with the chord read from the music database of the applicable musical piece (YES at step S1103), CPU 21 outputs the chord decided to be played in real time (step S1104), finishing the chord selecting process.

Meanwhile, when the chord decided to be played in the automatic chord judging process (chord decided to be played in real time) do not match with the chord read from the music database of the applicable musical piece (NO at step S1103), CPU 21 outputs the chord read from the music database of the applicable musical piece (step S1105), finishing the chord selecting process.

Figure 25:
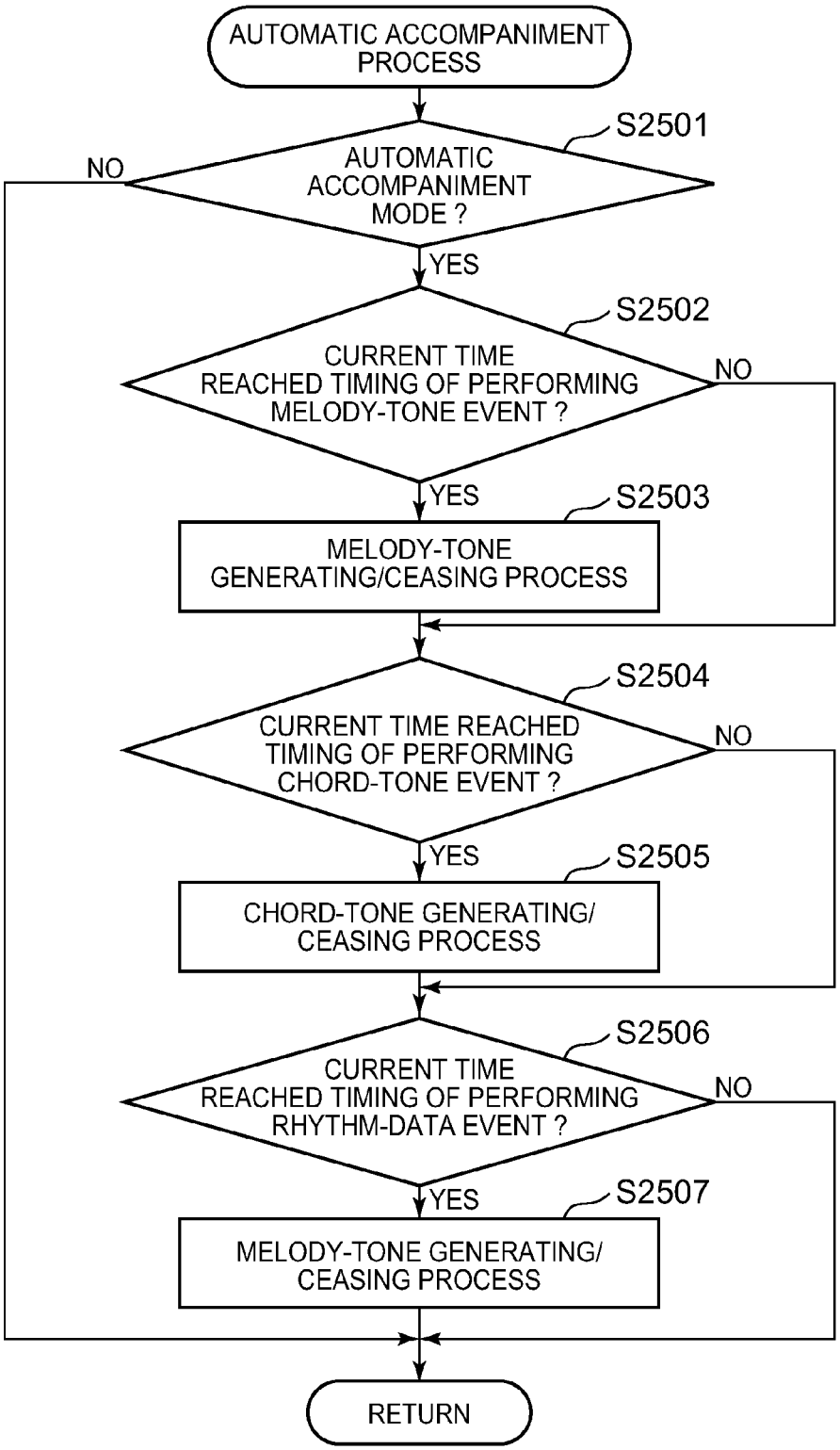
FIG. 25 is a flow chart of an example of an automatic accompaniment process in the present embodiment of the invention.

When the chord selecting process has finished as described above (step S307 in FIG. 3 and the process shown in FIG. 11), CPU 21 advances to step S308 to perform an automatic accompaniment process. The automatic accompaniment process is shown in FIG. 25 in detail.

The automatic accompaniment process will be described with reference to a flow chart of FIG. 25. CPU 21 judges whether the automatic-accompaniment mode has been set in the electronic musical instrument 10 (step S2501). When it is determined that the automatic-accompaniment mode has been set (YES at step S2501), CPU 21 refers to a timer (not shown) to judge whether the current time has reached a timing of performing an event of the data of melody tones in the automatic accompaniment data (step S2502).

The automatic accompaniment data contains data of musical tones such as melody tones (including obbligato tones), chord tones, and rhythm tones. The data of melody tones and data of chord tones contain a pitch, a generation timing and a duration of each musical tone to be generated. The data of rhythm tones contains a generation timing of each musical tone (rhythm tone) to be generated.

When it is determined YES at step S2502, CPU 21 performs a melody-tone generating/ceasing process (step S2503). In the melody-tone generating/ceasing process, CPU 21 judges whether the event to be processed is a note-on event. When the current time has substantially reached a generation timing of a predetermined tone in the data of melody tones, then it can be determined that the event is a note-on event. Meanwhile, when the current time has substantially reached a time when a duration of a predetermined tone lapsed after the generation timing of the tone in the data of melody tones, then it can be determined that the event is a note-off event.

When the event to be processed is a note-off event, CPU 21 performs a tone ceasing process. Meanwhile, when the event to be processed is a note-on event, CPU 21 performs a tone generating process in accordance with data of melody tones.

Then, CPU 21 refers to the timer (not shown) to judge whether the current time has reached the timing of performing an event of the data of chord tones in the automatic accompaniment data (step S2504). When it is determined YES at step S2504, CPU 21 performs a chord-tone generating/ceasing process (step S2505). In the chord-tone generating/ceasing process, CPU 21 performs a tone generating process of the chord tone, a generation timing of which the current time has reached. Meanwhile, CPU 21 performs a tone ceasing process of the chord tone, a ceasing timing of which the current time has reached.

CPU 21 judges whether the current time has reached a timing of performing an event of the rhythm data in the automatic accompaniment data (step S2506). When it is determined YES at step S2506, CPU 21 performs a rhythm-tone generating process at step S2507. In the rhythm-tone generating process, CPU 21 produces note-on event of a rhythm tone, a generation timing of which the current time has reached.

When the automatic accompaniment process has finished (step S308 in FIG. 3), CPU 21 performs the sound-source sound generating process (step S309 in FIG. 3). In the sound-source sound generating process, CPU 21 supplies the sound source 26 with data indicating a tone color and a pitch of a musical tone to be generated in accordance with the produced note-on event, or with data indicating a tone color and a pitch of a musical tone to be ceased. The sound source 26 reads waveform data from ROM 22 in accordance with the data indicating a tone color, pitch, and duration to produce musical-tone data, whereby music is output from the speaker 28. CPU 21 gives the sound source 26 an instruction of ceasing a tone of a pitch indicated by the note-off event.

When the sound-source sound generating process has finished at step S309, CPU 21 performs other processes, such as displaying an image on the displaying unit 15 and turning on/off LED (not shown) at step S310, and returns to step S302.

As described above, in the present embodiment of the invention, the electronic musical instrument for automatically performing accompaniment along with a melody played by a performer is provided with the music data base, and refers to the music database to compare the melody played by the performer with the music pieces recorded in the music database. When music pieces which coincide in some conditions with the melody played by the performer are located in the music database, the chords of such music pieces are read from the music database, whereby an accompaniment is played along with the melody played by the performer.

In the manner described above, it is possible not only to determine chords to be played when the accompaniment is automatically performed in real time along with the melody played by the performer, but also to read the chords appropriate for the melody from the music database, thereby enhancing accuracy in automatically playing the chords to the melody.

In the present embodiment of the invention, in the process of comparing the entered melody with the music database, when the key (tonality) has not yet been established, the N-list of musical pieces is prepared to be used for comparing the pitches of musical tones, and the D-list of musical pieces is also prepared to be use for comparing the intervals to the preceding tones, whereby even if a melody should be played in a key other than the registered keys in the music database, the melody can be compared with the music database. Therefore, even though the performer should play a melody in a key different from the keys registered in the music database, appropriate chords will be played with effective use of the music database.

Further, in the present embodiment of the invention, ST ratio to the opening tone of each melody tone of the melody is registered in the music database. ST ratios to the opening tone of melody tones of the played melody are obtained and compared with ST ratios registered in the music database to calculate the accurate rate of the music pieces. Music pieces are selected in priority in order of decreasing accurate rate from among the musical pieces stored in the music database. Therefore, a flexible system can be constructed, which can extract musical pieces from the music database as far as the musical pieces have coincident features, even if the melody should have been played a little out of the tone generating timing.

The automatic chord judging process is performed in parallel with the process of searching through the music database, and the chords are played in accordance with result of performing the automatic chord judging process, in the case where an appropriate musical piece could not be found in the process of searching through the music database. The appropriate chords are found by two methods: the method of automatically judging chords; and the method of searching for chords through the music database. Therefore, when the appropriate music piece is registered in the music database, the correct chords are determined based on the music database and played immediately. When the appropriate music piece is not registered in the music database or is not distinguishable, chords will be found and played in the automatic chord judging process. As described above, in the present embodiment of the invention, correct chords can be found and automatically played in any event.

Now, the second embodiment of the invention will be described. In the second embodiment of the invention, CPU 21 performs a chord selecting process shown in FIG. 26 in place of the chord selecting process shown in FIG. 11.

Figure 26:
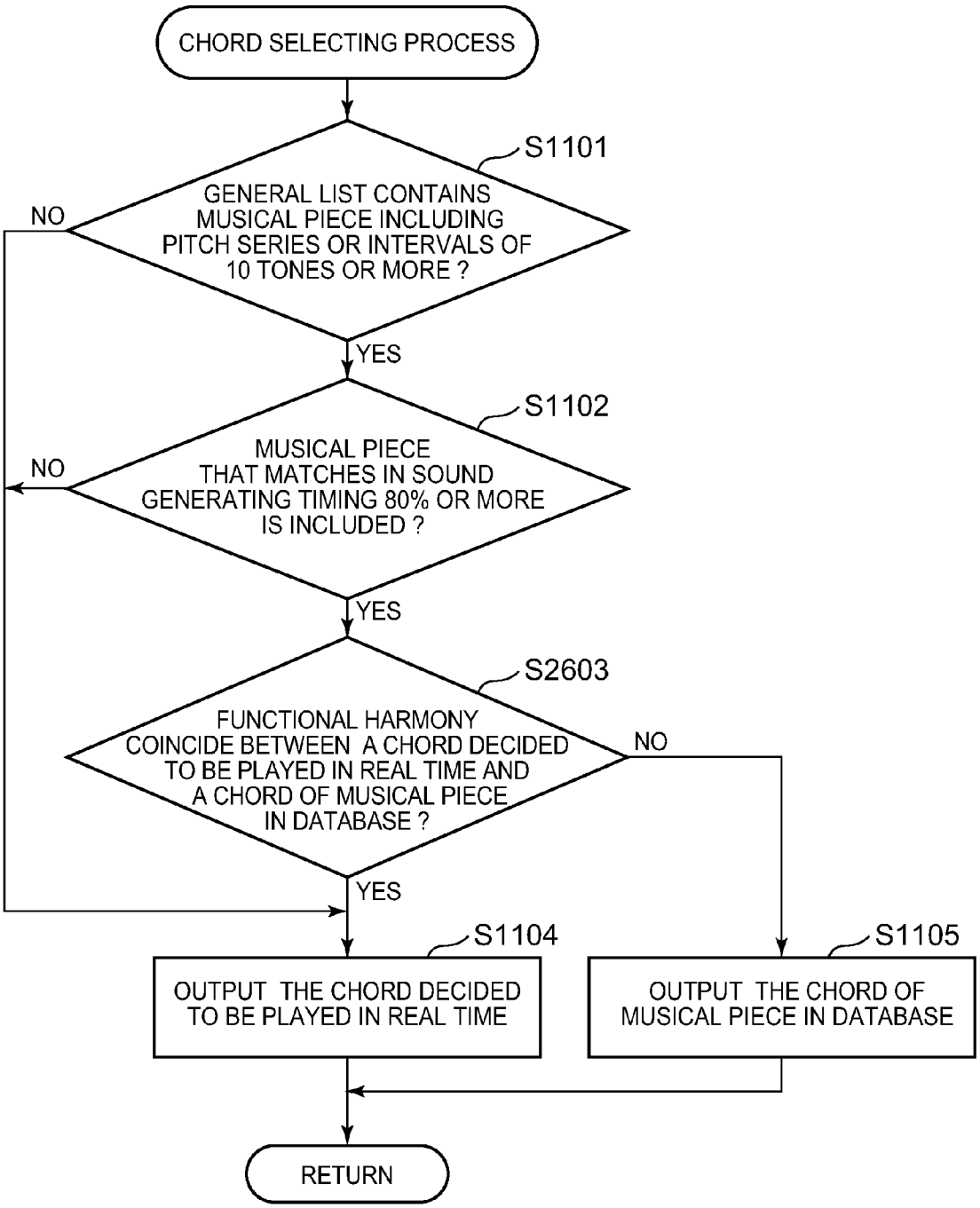
FIG. 26 is a flow chart showing an example of a chord selecting process in the second embodiment of the invention.

In the chord selecting process shown in FIG. 26, like processes as those in FIG. 11 are designated by like step numbers, and their description is omitted there. In the chord selecting process shown in FIG. 26, a process at step S2603 will be performed in place of the process at step S1103 in FIG. 11.

In the process at step S2603, CPU 21 compares "functional harmonies" between the chord decided to be played or added to the performed melody in the automatic chord judging process at step S306 and the chord played or added to the melody of musical pieces performed currently, which musical pieces are found in the music database at step S1101 and decided at step S1102 that they satisfy the conditions.

More specifically, as the above "functional harmonies" of the chords in the music database, information of the "functional harmony" added to each melody tone in the music database shown in FIG. 12 and recorded therein will be used. Further, since the key (tonality) is determined in each musical piece in the music database shown in FIG. 12, it is possible to judge the "functional harmonies" of the chords by comparing the tonality with the chords of each musical piece.

For the functional harmonies of chords to be played or provided to the melody performed currently, it is possible to use the functions of the assumed chords stored in the item of assumed function, which was described in relation to the key (tonality) judging process (step S305). It is possible to judge the functions (assumed functions) of chords to be played or added to the melody performed currently, by comparing information of the assumed key or the established key, described in relation to the step S305, with information of the chord added to the melody performed currently.

More specifically, concerning various sorts of chords and functional harmonies of the chords, a table according to the known music theory is prepared. Referring to this table, the functional harmonies of the chords will be obtained. For example, the following chord names for the tonic will be listed as follows: "I Maj", "I M7", "III min", "III m7", "VI min", and "VI m7". The chord names for the subdominant are "II min", "II m7", "II $m7^{(-5)}$", "IV Maj", "IV M7", "IV min", and "IV mM7". The chord names for the dominant are "III Maj", "III7", "III 7sus4", "V Maj", "V 7", "V 7sus4" and "VII $m7^{(-5)}$".

At step S2603, CPU 21 compares the "functional harmonies" between the chord decided to be played to the performed melody in the automatic chord judging process (step S306) and the chord played or added to the melody of musical pieces performed currently, which musical pieces are found in the music database at step S1101 and decided at step S1102 that they coincide with the conditions.

When it is determined that the "functional harmonies" of the both chords share common functions (YES at step S2603), CPU 21 outputs the chord decided to be played or added to the melody performed in real time in the automatic chord judging process (step S1104). Meanwhile, when it is determined that the "functional harmonies" of the both chords do not share common functions (NO at step S2603), CPU 21 reads the chord of the music piece from the music database to output said chord (step S1105).

In the second embodiment of the invention, when the "functional harmonies" of the chords decided to be played or added to the played melody in real time and the "functional harmonies" of the chords read from the music database share common functions, CPU 21 chooses and outputs the chords decided to be played or added to the melody in real time with full respect for them, from among a wide variety of chords sharing the common functions. Meanwhile, when the "functional harmonies" of the chords decided to be played or added to the played melody in real time and the "functional harmonies" of the chords read from the music database do not share common functions, CPU 21 can output the chords read from the music database in order to prevent the chords decided to be played or added in real time from providing functionally impossible harmony. According to the second embodiment of the invention, using both the method of selecting chords from the music database and the method of playing chords decided in real time, it will be possible to select chords from among a variety of chords sharing common function to output the selected chords with full respect for the chords decided to be plated or added to a melody in real time, with decreasing possibility of outputting almost impossible chords.

Although specific embodiments of the invention have been described in the foregoing detailed description, it will be understood that the invention is not limited to the particular embodiments described herein, modifications and rearrangements may be made to the disclosed embodiments while remaining within the scope of the invention as defined by the following claims. It is intended to include all such modifications and rearrangements in the following claims and their equivalents.

The methods described in the embodiments of the present invention can be written as a computer executable program onto recording media, such as magnetic disks (floppy disks, hard-disk drives, etc.), optical disks (CD-ROMs, DVDs, etc.), and semi-conductor memories. The recording media are distributed and installed on various devices. Also, the methods can be transferred through communication media to various devices. A computer for realizing the present instrument reads the program from the recording medium, and operates under control of the program to perform the processes.

In the description, the various processes or steps included in the program written on the recording media are performed in a time-serial order, but are not always required to be performed in the time-serial order and can be performed in parallel or separately from each other.

In the description, terms concerning the system mean a whole apparatus consisting of plural apparatuses and plural methods.

Some of processes shown in FIG. 3 can be changed in the order to be executed. For example, it is possible to change in the sequence of execution the candidate-music searching process of step S304 with the key (tonality) judging process of step S305 and the automatic chord judging process of step S306. In this case, it will be possible to make judgment based on the latest data resulting from the key judging process (step S305).

According to the invention described above, since it is possible to creatively use the following two methods to play the chords: the method of automatically playing the chords based on the melody history; and the method of playing the chords in accordance with the music database, more preferable chords can promptly be provided with high accuracy.

In other words, when no appropriate musical piece has been found among the musical pieces registered in the music database, the chords are played to the melody performed by the performer by the method of automatically playing the chords. Therefore, even though the appropriate musical piece has not been found in the music database, a situation can be avoided, where the performer plays a melody with no automatic accompaniment played together.

Meanwhile, when the appropriate musical piece has been found among the musical pieces registered in the music database, using the chords registered in the music database, an accompaniment is automatically played together with the melody performed by the performer. Therefore, when the chords are automatically determined, a situation can be avoided, where chords which are apparently and aurally impossible are played.

According to the invention described above, when an appropriate musical piece has been found among the musical pieces registered in the music database, the "functional harmonies" of the chords output by the method of automatically playing the chords based on the melody history and the "functional harmonies" of the chords output by the method of playing the chords in accordance with the music database are compared to chose the chords to use. Therefore, it is possible to prevent causing an outstanding trouble that the method of automatically providing the chords provides the chords which are impossible and greatly different in functional harmony from the chords recorded in the music database.

Further, when the "functional harmonies" of the chords output by the method of automatically providing the chords based on the melody history and the "functional harmonies" of the chords output by the method of providing the chords in accordance with the music database are compared, and both the "functional harmonies" of the chords are substantially the same, upon confirming that the chords output by the method of automatically providing the chords by no means provide impossible functions, it is possible to chose the chords using an algorithm of the automatically providing the chords with full respect for the algorithm, whereby accompaniment can be performed using more appropriate chords.

What is claimed is:

1. An automatic accompaniment apparatus comprising:

a music database having plural pieces of music data recorded therein, the plural pieces of music data corresponding respectively to plural musical pieces, and each piece of music data including melody information and chords corresponding to the melody information;

a performance recording unit which records performed melody information for successively giving an instruction of generating a musical tone in response to an operation performed on a performance operating device;

a music searching unit which searches for a musical piece having music data including melody information corresponding to the performed melody information recorded in the performance recording unit through the music database;

a chord judging unit which judges a chord based on the performed melody information recorded in the performance recording unit;

a chord selecting unit which selects one chord from among (i) a chord included in the music data of the musical piece found by the music searching unit and (ii) the chord judged by the chord judging unit as the chord to be used; and an automatic accompaniment unit which gives an instruction of generating accompaniment in accordance with the chord selected by the chord selecting unit.

2. The automatic accompaniment apparatus according to claim 1, wherein the chord selecting unit compares (i) functional harmonies of the chord included in the music data of the musical piece found by the music searching unit with (ii) functional harmonies of the chord judged by the chord judging unit, and selects the chord based on a result of the comparison.

3. The automatic accompaniment apparatus according to claim 2, wherein the chord selecting unit selects the chord judged by the chord judging unit, when both functional harmonies coincide with each other between the chord included in the music data found by the music searching unit and the chord judged by the chord judging unit, and selects the chord included in the music data, when both functional harmonies do not coincide with each other.

4. The automatic accompaniment apparatus according to claim 1, wherein the chord selecting unit selects the chord judged by the chord judging unit, when no musical piece having melody information corresponding to the performed melody information has been found in the music database by the music searching unit.

5. The automatic accompaniment apparatus according to claim 1, wherein the music searching unit searches for musical pieces having the melody information corresponding to the performed melody information in order of ratio of note duration through the music database, based on a ratio in duration to a first musical tone of each entered musical tone among musical tones successively instructed so as to generate sound by the performance operating device.

6. The automatic accompaniment apparatus according to claim 1, wherein:

the chord judging unit comprises a key judging unit which judges a key of the performed melody information sent from the performance operating device, and the music searching unit transposes the music data in the music database to the key judged by the judging unit, and searches for music pieces having the melody information corresponding to the performed melody information through the music database, based on the transposed music data and the performed melody information recorded in the performance recording unit.

7. The automatic accompaniment apparatus according to claim 6, wherein the music searching unit searches for musical pieces having the melody information corresponding to the performed melody information through the music database, based on at least one of pitch data included in the melody information of the music data recorded in the music database and interval data indicating relative intervals between adjacent pieces of pitch data, when the key judging unit determines that the key of the performed melody information has not been established.

8. The automatic accompaniment apparatus according to claim 1, wherein each piece of music data in the music database is recorded in a single key.

9. The automatic accompaniment apparatus according to claim 1, wherein plural pieces of music data in the music database are recorded in keys of their own original musical pieces respectively.

10. A method of automatically performing accompaniment in an automatic accompaniment apparatus provided with (i) a music database having plural pieces of music data recorded therein, the plural pieces of music data corresponding respectively to plural musical pieces, and each piece of music data including melody information and chords corresponding to the melody information, and (ii) a performance recording unit which records performed melody information for successively giving an instruction of generating a musical tone in response to an operation performed on a performance operating device, the method comprising:

a step of searching for a musical piece having music data including melody information corresponding to the performed melody information recorded in the performance recording unit through the music database;

a step of judging a chord based on the performed melody information recorded in the performance recording unit;

a step of selecting one of (i) a chord included in the music data of the musical piece found at the searching step and (ii) the chord judged at the judging step as the chord to be used; and a step of giving an instruction of performing accompaniment in accordance with the chord selected at the selecting step.

11. A non-transitory computer-readable recording medium having an executable program stored thereon, wherein a computer is used in an automatic accompaniment apparatus provided with (i) a music database having plural pieces of music data recorded therein, the plural pieces of music data corresponding respectively to plural musical pieces, and each piece of music data including melody information and chords corresponding to the melody information, and (ii) a performance recording unit which records performed melody information for successively giving an instruction of generating a musical tone in response to an operation performed on a performance operating device, the program being executable to control the computer to perform functions comprising:

a music searching step of searching for music data including melody information corresponding to the performed melody information recorded in the performance recording unit through the music database;

a chord judging step of judging a chord based on the performed melody information recorded in the performance recording unit;

a chord selecting step of selecting one of (i) a chord included in the music data of the musical piece found at the searching step and (ii) the chord judged at the chord judging step as the chord to be used; and an automatic accompaniment step of giving an instruction of performing accompaniment in accordance with the chord selected at the chord selecting step.

* * * * *